US008686639B2

(12) United States Patent
Hatase et al.

(10) Patent No.: US 8,686,639 B2
(45) Date of Patent: Apr. 1, 2014

(54) DIELECTRIC BARRIER DISCHARGE LAMP AND LAMP UNIT

(75) Inventors: Kazuya Hatase, Kyoto (JP); Tsuyoshi Katagiri, Kyoto (JP); Koji Hosotani, Kyoto (JP)

(73) Assignee: GS Yuasa International Ltd., Kyoto (JP)

( * ) Notice: Subject to any disclaimer, the term of this patent is extended or adjusted under 35 U.S.C. 154(b) by 0 days.

(21) Appl. No.: 13/581,611

(22) PCT Filed: Mar. 8, 2011

(86) PCT No.: PCT/JP2011/055308

§ 371 (c)(1), (2), (4) Date: Aug. 29, 2012

(87) PCT Pub. No.: WO2011/114937

PCT Pub. Date: Sep. 22, 2011

(65) Prior Publication Data

US 2012/0319578 A1 Dec. 20, 2012

(30) Foreign Application Priority Data

Mar. 18, 2010 (JP) ..... 2010-062750
Mar. 18, 2010 (JP) ..... 2010-062786
Sep. 7, 2010 (JP) ..... 2010-199765

(51) Int. Cl.
*H01J 61/54* (2006.01)

(52) U.S. Cl.
USPC ..... 313/607; 313/626; 313/627; 313/641

(58) Field of Classification Search
CPC ..... H01J 65/00; H01J 61/16; H01J 11/00
USPC ..... 313/607, 623, 627, 631, 491, 487; 445/24, 25
See application file for complete search history.

(56) References Cited

U.S. PATENT DOCUMENTS

2006/0066211 A1* 3/2006 Bschorer et al. ..... 313/491
2009/0121649 A1* 5/2009 Takata ..... 315/291

FOREIGN PATENT DOCUMENTS

JP 2000-260396 9/2000
JP 2006-092911 4/2006
JP 2006-100278 4/2006

* cited by examiner

*Primary Examiner* — Tracie Y Green
(74) *Attorney, Agent, or Firm* — Jianq Chyun IP Office

(57) ABSTRACT

A dielectric barrier discharge lamp is described, including a discharge tube having an elongated shape and enclosing a discharge gas therein, and a pair of electrodes. A portion of an outer peripheral surface of the discharge tube in a longitudinal direction of the discharge tube is defined as a light extraction area for extracting light induced in the discharge tube to an outside. The pair of the electrodes are placed on the outer peripheral surface such that the light extraction area is positioned between the pair of the electrodes in a peripheral direction of the outer peripheral surface of the discharge tube.

17 Claims, 20 Drawing Sheets

DIELECTRIC BARRIER DISCHARGE LAMP AND LAMP UNIT

CROSS-REFERENCE TO RELATED APPLICATION

This application is a 371 of international application of PCT application serial no. PCT/JP2011/055308, filed on Mar. 8, 2011, which claims the priority benefit of Japan application no. 2010-062750, filed on Mar. 18, 2010, Japan application no. 2010-062786, filed on Mar. 18, 2010 and Japan application no. 2010-199765, filed on Sep. 7, 2010. The entirety of each of the above-mentioned patent applications is hereby incorporated by reference herein and made a part of this specification.

TECHNICAL FIELD

This invention relates to dielectric barrier discharge lamps and lamp units.

BACKGROUND ART

Dielectric barrier discharge lamps are used for optically cleaning to-be-treated objects (such as semiconductors, glass substrates used in liquid crystal display devices, and the like). Conventional dielectric barrier discharge lamps have been adapted to include a solid electrode placed on the upper surface of a discharge tube and a mesh electrode placed on the lower surface thereof, such that ultraviolet rays are emitted through the interstices of the meshes in the mesh electrode (refer to Patent Document 1). Further, since ultraviolet rays are directed to the surfaces of to-be-treated objects, the organic substances on the surfaces of the to-be-treated objects are decomposed thereby, so that the to-be-treated objects are cleaned.

Patent Document 1: JP-A No. 2000-260396

SUMMARY OF THE INVENTION

Problems to be Solved by the Invention

As described above, conventional dielectric barrier discharge lamps have been adapted to include a mesh electrode placed in a light extraction area (a lower surface) for extracting light, in a discharge tube. Therefore, the meshes of the mesh electrode have intercepted a portion of light emitted from the light extraction area, thereby degrading the light transmittance.

This invention was made in view of the aforementioned circumstances and has an object of providing a dielectric barrier discharge lamp capable of increasing the light transmittance in a light extraction area.

Means for Solving the Problems

As means for attaining the aforementioned object, according to this invention, there is provided a dielectric barrier discharge lamp including: a discharge tube having an elongated shape and enclosing a discharge gas therein, and a pair of electrodes;

wherein a portion of an outer peripheral surface of the discharge tube in a longitudinal direction of the discharge tube is defined as a light extraction area for extracting light induced in the discharge tube to an outside, and the pair of the electrodes are placed on the outer peripheral surface such that the light extraction area is positioned between the pair of the electrodes in a peripheral direction of the outer peripheral surface.

According to this invention, the pair of the electrodes are placed such that the light extraction area is positioned between both the electrodes in the peripheral direction of the outer peripheral surface of the discharge tube, so that no electrode does not exist in this light emission area. This can increase the light transmittance, in comparison with conventional structures having electrodes placed in light extraction areas. Further, according to this invention, it is possible to prevent the inner surface in the light extraction area from being directly exposed to plasmas, which can suppress the reduction of the light transmittance.

On the other hand, in cases of extracting light from discharge lamps including mesh electrodes, in order to prevent reduction of the light transmittance due to micro-sputtering induced by the mesh electrodes, there has been a need to provide protective films (such as $MgF_2$) with optical transparency, which may have involved cost increases. However, according to this invention, there is no need to provide such mesh electrodes which induce micro-sputtering, which eliminates the necessity for such protective films with optical transparency.

The dielectric barrier discharge lamp of this invention may have the structure:

(1) It may include a pair of holding blocks adapted to hold respective end portions of the discharge tube in the longitudinal direction, wherein at least one electrode, out of the pair of the electrodes, may be constituted by a rod-shaped member extending in the longitudinal direction, and this rod-shaped electrode may be coupled at its respective end portions to the holding blocks.

With this structure, the electrode constituted by the rod-shaped member has the function of protecting the discharge tube as a structural member (a beam), since it couples the pair of the holding blocks for holding the respective end portions of the discharge tube in the longitudinal direction, to each other. This can reduce the number of members, in comparison with structures provided with additional structural members besides the electrodes.

In the structure (1), the discharge tube may be constituted by a round tube with a circular-shaped cross section, and an inner surface of the rod-shaped electrode which faces the discharge tube may form a curved surface and may have a curvature equal to or less than a curvature of the outer peripheral surface of the discharge tube.

If the curvature of the inner surface of the electrode is larger than that of the discharge tube, the sputtering induced between both the members easily leaks to the outside. This may cause metal films and the like having been induced by such sputtering to be adhered to the light extraction area, thereby reducing the light transmittance of this light extraction area. To cope therewith, by employing the aforementioned structure, it is possible to suppress leakages of sputtering to the outside.

In the structure (1), an outer surface of the rod-shaped electrode other than the inner surface facing the discharge tube may be provided with a tapered surface between adjacent surfaces.

With this structure, it is possible to eliminate angular portions from the electrode, which can suppress occurrence of corona discharge at its outer surface.

In the structure (1), the holding blocks may be provided, in their facing surfaces which face the end portions of the discharge tube in the longitudinal direction, with a discharge-tube housing portion adapted to house the discharge tube, and electrode housing portions which are placed to sandwich the discharge-tube housing portion therebetween and are adapted to house the pair of the electrodes. With this structure, the discharge tube is protected by the holding blocks, in a state where the discharge tube is sandwiched between the pair of the electrodes and is integrated therewith.

In the aforementioned structure, the holding blocks may be provided with through holes which are continuous with back surfaces of the electrode housing portions facing end surfaces of the electrodes and reach non-facing surfaces of the holding blocks in the opposite side from their facing surfaces, and the end surfaces of the electrodes may be provided with screw holes which allow screws inserted through the through holes to be screwed thereinto.

With this structure, since the screws inserted through the through holes in the electrode housing portions are screwed into the screw holes formed in the end surfaces of the electrodes, the electrodes are firmly secured to the holding blocks.

In the aforementioned structure, an angle of the end surfaces of the electrodes with respect to a direction perpendicular to the longitudinal direction of the discharge tube may be different from an angle of the back surfaces of the electrode housing portions with respect to a direction perpendicular to the longitudinal direction of the discharge tube, whereby the electrodes are caused to press the discharge tube when the electrodes are coupled to the holding blocks.

With this structure, when the electrodes are coupled to the holding blocks, the electrodes are caused to press the discharge tube, which can certainly reduce the areas in which the discharge tube and the electrodes are not in contact with each other.

In the structure (1), a conductive elastic member may be inserted between the discharge tube and the one electrode, in a state where the elastic member is being elastically deformed. With this structure, the elastic member can reduce the areas in which the discharge tube and the electrode are not in contact with each other, which can suppress the occurrence of discharge between the discharge tube and the electrode when the discharge tube is lighted.

(2) The dielectric barrier discharge lamp may include a pair of holding blocks adapted to hold respective end portions of the discharge tube in the longitudinal direction, and a beam member which is constituted by a rod-shaped member extending in the longitudinal direction and is coupled to the holding blocks at its respective end portions in the longitudinal direction, wherein at least one electrode, out of the pair of the electrodes, may be placed between the beam member and the outer peripheral surface of the discharge tube and may be adapted to be pressed against the outer peripheral surface by the beam member coupled to the holding blocks.

With this structure, the at least one electrode is pressed against the outer peripheral surface of the discharge tube by the beam member, which can certainly bring this electrode into contact with the outer peripheral surface. Further, the beam member itself functions as a structural member and, therefore, the aforementioned one electrode itself is not required to have a high strength.

In the structure (2), at least one electrode, out of the pair of the electrodes, may have a flat-plate shape extending in the longitudinal direction, the beam member may be provided with a slot in the longitudinal direction, in its facing surface which faces the outer peripheral surface, and the one electrode may be pressed against the outer peripheral surface while being curved into a U shape by being pressed by opposite edges of the slot in the facing surface, by being coupled to the holding blocks.

With this structure, the electrode having the flat-plate shape is pressed against the outer peripheral surface of the discharge tube while being curved into a U shape by the opposite edges of the slot formed in the beam member, which can certainly bring the opposite edges of the aforementioned one electrode into contact with the outer peripheral surface.

In the structure (2), the electrode having the flat-plate shape extending in the longitudinal direction may be provided with plural slits. With this structure, it is possible to release heat through the slits for preventing the deformation of the electrode having the flat-plate shape due to thermal expansion thereof, when the electrode having the flat-plate shape is subjected to heat.

In the structure (2), the electrode having the flat-plate shape extending in the longitudinal direction may be provided with a displacement prevention protruding portion which is formed to protrude in a direction intersecting with the longitudinal direction and is inserted in the slot in the beam member for preventing displacement of the electrode with the flat-plate shape. With this structure, the electrode is positioned at a predetermined position on the beam member and is therefore inhibited from being displaced therefrom.

(3) The discharge tube may be constituted by a round tube having a circular-shaped cross section, the discharge tube may be provided with an engagement portion, and at least one holding block, out of the pair of the holding blocks, may be provided with a to-be-engaged portion adapted to engage with the engagement portion.

If the electrodes and the discharge tube rotate with respect to each other, the light extraction area may be partially formed by areas of the discharge tube which have been contaminated by the electrode material sputtered onto the discharge tube due to small discharge induced in the gaps between the discharge tube and the electrodes and at the edge portions of the electrodes, thus resulting in reduction of the light transmittance of the light extraction area.

However, with the aforementioned structure, due to the engagement between the engagement portion and the to-be-engaged portion, it is possible to prevent rotations of the electrodes and the discharge tube with respect to each other, thereby suppressing the reduction of the light transmittance in the light extraction area.

(4) Out of two portions of the discharge tube which are sandwiched between the pair of the electrodes, one portion may be defined as the light extraction area, while an insulating reflective film may be formed on the other portion.

With this structure, there is no need to provide an additional reflection plate. Further, since the reflective film has an insulating property, it is possible to prevent short circuits between the pair of the electrodes.

Further, as means for attaining the aforementioned object, according to this invention, there is provided a lamp unit including: a dielectric barrier discharge lamp arrangement including a plurality of the aforementioned dielectric barrier discharge lamps such that the dielectric barrier discharge lamps are placed and arranged in a direction intersecting with the longitudinal direction of the discharge tubes, a first support member adapted to comprehensively support the holding blocks in the dielectric barrier discharge lamps in one side in the longitudinal direction, and a second support member adapted to comprehensively support the holding blocks in the dielectric barrier discharge lamps in the other side in the longitudinal direction.

According to this invention, the plural dielectric barrier discharge lamps having the light extraction areas with higher light transmittance than conventional structures are integrated by the support members and the beam members, in a state where they are placed in parallel. This can improve the usability of the dielectric barrier discharge lamps, for example, in a way to enable comprehensively extracting the plural dielectric barrier discharge lamps from a predetermined install place for replacement operation.

The lamp unit according to this invention may have the following structure.

At least one electrode, out of the pair of the electrodes included in each of the dielectric barrier discharge lamps, may have a rod shape extending in the longitudinal direction. This rod-shaped electrode may be coupled, at its respective end portions, to the first support member and the second support member to form the beam member.

With this structure, at least one electrode, out of the pair of electrodes included in each dielectric barrier discharge lamp, is formed from a conductive rod-shaped member and thus forms a beam member. Hence, this one electrode protects the discharge tube in each dielectric barrier discharge lamp. Further, since the electrode also functions as the beam member, it is possible to reduce the number of members, in comparison with structures in which both the members are formed from different members.

The above beam members are provided to the respective dielectric barrier discharge lamps, such that at least one beam member is for each dielectric barrier discharge lamp, and at least one electrode, out of the pair of electrodes included in each dielectric barrier discharge lamp, is placed between one of the beam members and the outer peripheral surface of the discharge tube, whereby it is pressed against the outer peripheral surface by the beam member coupled to the $1^{st}$ and the $2^{nd}$ support members.

With this structure, the at least one electrode is pressed against the outer peripheral surface of the discharge tube by the beam member, which can certainly bring this electrode into contact with the outer peripheral surface. Further, each beam member itself functions as a structural member and, therefore, the aforementioned one electrode itself is not required to have a high strength.

The first support member may be constituted by a feeding member connected to a first power-supply terminal connected to a power supply, the second support member may be constituted by a feeding member connected to a second power-supply terminal connected to the power supply, and in two of the dielectric barrier discharge lamps adjacent to each other, the electrodes facing each other may be commonly connected to one of the first supporting member and the second supporting member.

With this structure, in two dielectric barrier discharge lamps adjacent to each other, the electrodes facing each other are commonly connected to one of the first support member and the second support member. Hence, for example, in a structure in which one electrode and the other electrode, out of two electrodes facing each other, are connected to the first support member and the second support member, respectively, it is possible to prevent accidents of short circuits between both of the electrodes. This enables reducing the spacing of the dielectric barrier discharge lamps.

The first support member may be constituted by a feeding member which is formed from a conductive rod-shaped member extending in the intersecting direction and is connected to a first power-supply terminal connected to a power supply. The second support member may be constituted by a feeding member which is formed from a conductive rod-shaped member extending in the intersecting direction and is connected to a second power-supply terminal connected to the power supply. Out of the pair of the electrodes included in each of the dielectric barrier discharge lamps, one electrode may be electrically connected to the first support member, while the other electrode may be electrically connected to the second support member.

With this structure, the first support member and the second support member are formed from rod-shaped members and thus form structural members in the direction of the arrangement of the dielectric barrier discharge lamps (in the above intersecting direction), and, further, the first and the second support member can function as feeding members for supplying electric power from the power supply to the electrodes.

Between two dielectric barrier discharge lamps adjacent to each other, there may be provided a biasing member for biasing the electrodes facing each other, in directions that they get away from each other.

With this structure, the respective electrodes are pressed against the outer peripheral surfaces of the discharge tubes, due to the biasing force of the biasing member. This can reduce the areas in which the electrodes and the discharge tubes are not in contact with each other, thereby suppressing the occurrence of discharge between the discharge tubes and the electrodes when the discharge tubes are lighted.

Effects of the Invention

With this invention, it is possible to increase the light transmittance of the light extraction area.

DESCRIPTION OF THE EMBODIMENTS (First Embodiment)

A first embodiment of this invention will be described with reference to FIGS. 1 to 10. Further, in the respective figures, the arrow X indicates the rightward direction of the lamp unit 10 and the dielectric barrier discharge lamps 1 (the longitudinal direction of the dielectric barrier discharge lamps 1), the arrow Y indicates the forward direction, and the arrow Z indicates the upward direction.

1. The Entire Structure of the Lamp Unit

Figure 1:
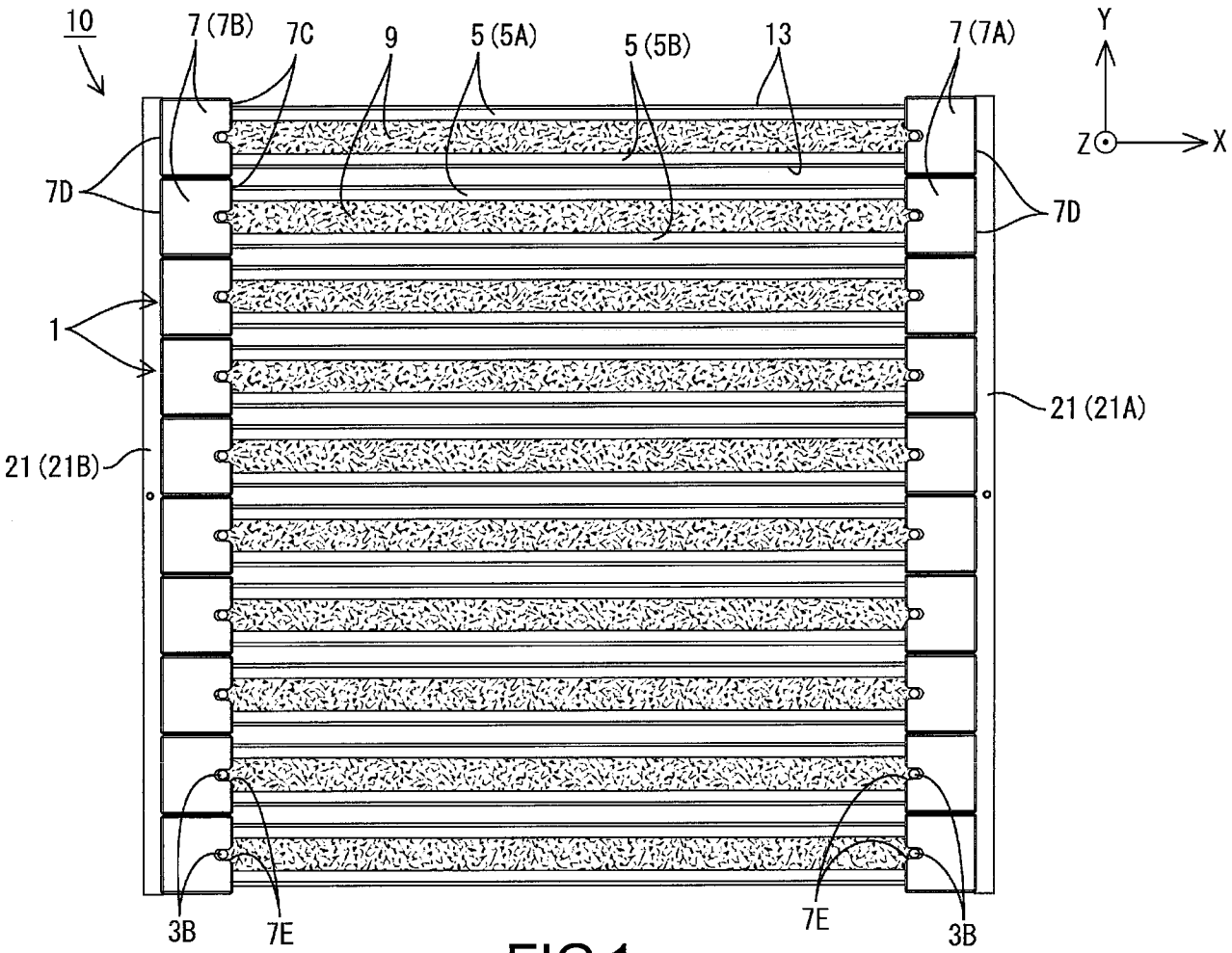
FIG. 1 is a top view of a lamp unit according to a first embodiment.
Figure 2:
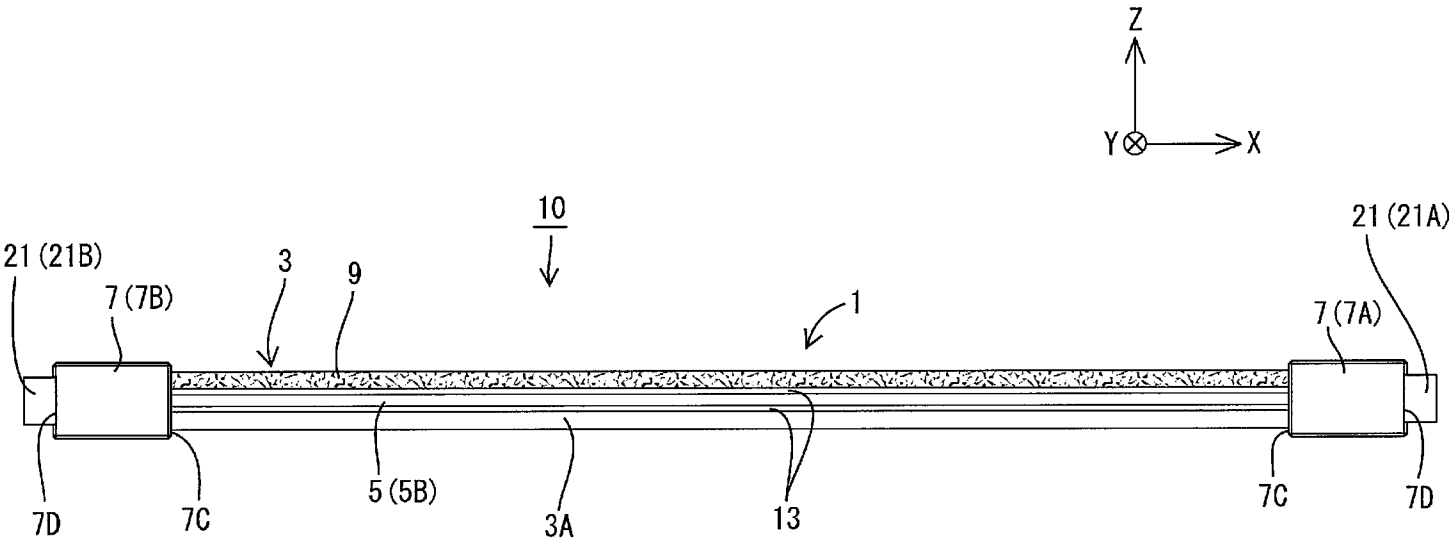
FIG. 2 is a front view of the lamp unit.
Figure 3:
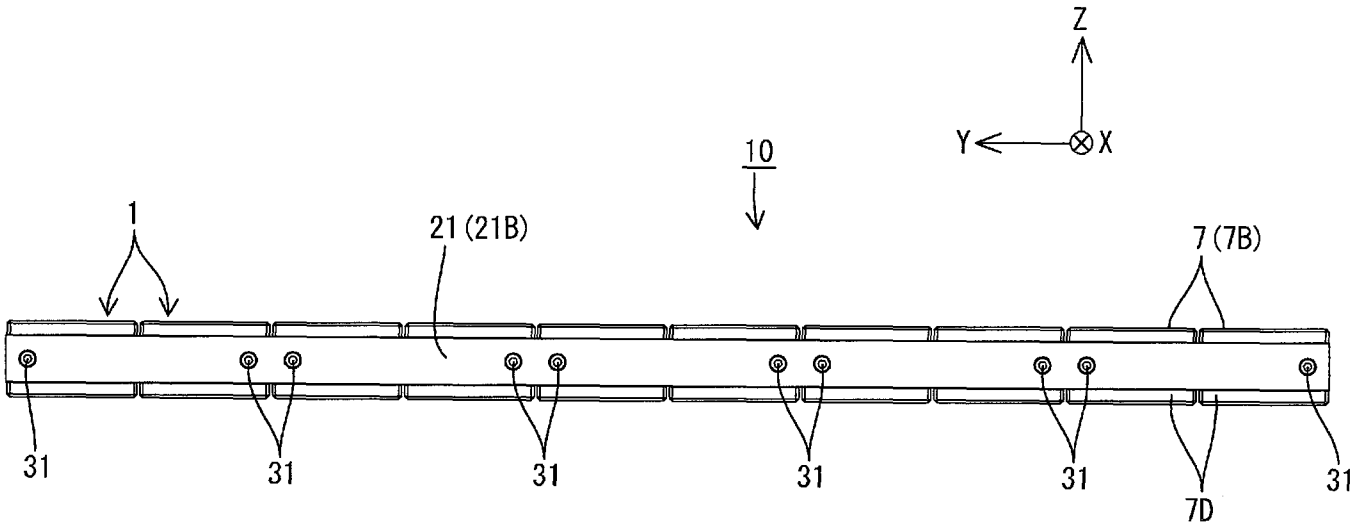
FIG. 3 is a left side view of the lamp unit.
Figure 4:
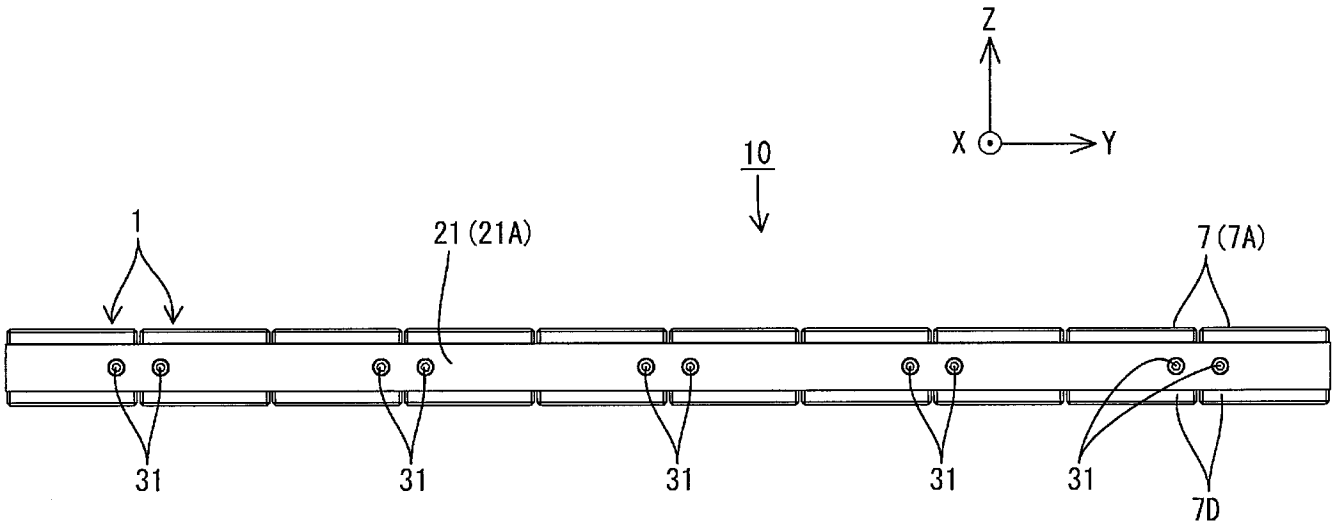
FIG. 4 is a right side view of the lamp unit.

FIG. 1 is a top view of the lamp unit 10 according to this embodiment, FIG. 2 is a front view thereof, FIG. 3 is a left side view thereof and FIG. 4 a right side view thereof. As shown in FIG. 1, the lamp unit 10 includes a plurality of (e.g., ten) dielectric barrier discharge lamps 1 that are integrated in a state where they are arranged in the forward and rearward directions. More specifically, the lamp unit 10 is structured to include the aforementioned plurality of the dielectric barrier discharge lamps 1 (a dielectric barrier discharge lamp arrangement 2), and a pair of feeding members 21 (an example of a first support member 21A and a second support member 21B).

2. The Structure of Each Dielectric Barrier Discharge Lamp

Figure 5:
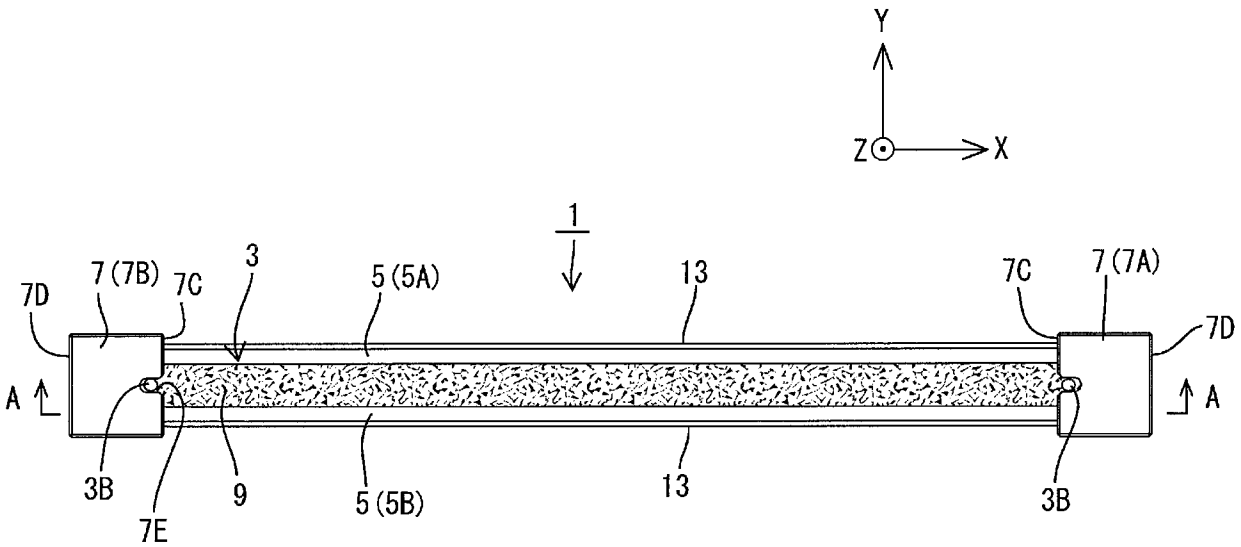
FIG. 5 is a top view of a dielectric barrier discharge lamp.
Figure 6:
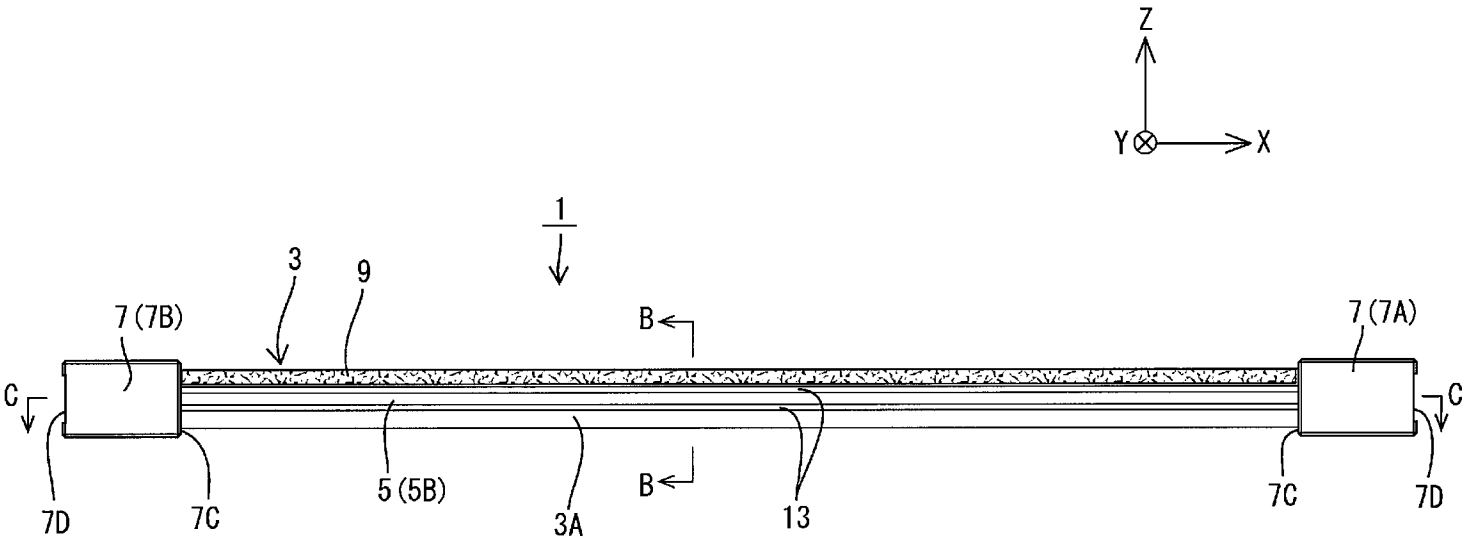
FIG. 6 is a side view of the dielectric barrier discharge lamp.
Figure 7:
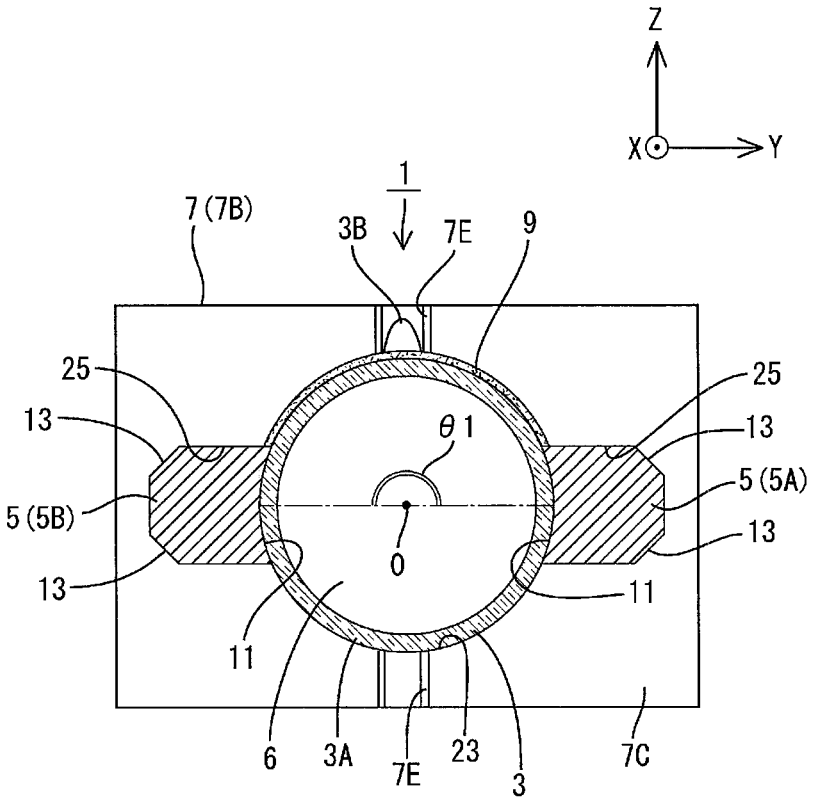
FIG. 7 is a cross-sectional view taken along the line B-B in FIG. 6.

FIG. 5 is a top view of a dielectric barrier discharge lamp 1, FIG. 6 is a side view thereof, and FIG. 7 is a cross-sectional view taken along the line B-B in FIG. 6. Each dielectric barrier discharge lamp 1 includes a discharge tube 3, a pair of side-surface electrodes 5, 5 (an example of electrodes), and a pair of holding blocks 7, 7.

In the outer peripheral surface of the discharge tube 3 along the leftward and rightward directions (the longitudinal direction), its lower-surface side (an example of "a portion of the outer peripheral surface") is defined as a light extraction area 3A for extracting light induced within the discharge tube 3 to outside (see FIG. 6). The pair of the side-surface electrodes 5, 5 are placed on the outer peripheral surface of the discharge tube 3 such that the light extraction area 3A is positioned between both the electrodes 5, 5 in the peripheral direction of the outer peripheral surface thereof. Hereinafter, both side-surface electrodes will be referred to as "a side-surface electrode 5A and a side-surface electrode 5B", when they are distinguished from each other.

(1) The Discharge Tube

The discharge tube 3 has a single-tube structure, which is made of a synthetic silica glass and is formed from a circular-cylindrical tube closed at its opposite ends. Namely, the discharge tube 3 is constituted by a round tube having a circular cross section, as shown in FIG. 7. A discharge space 6 formed inside the discharge tube 3 is filled with a dielectric-barrier discharge gas. Further, the dielectric barrier discharge lamp 1 employs, as the discharge tube 3, a round tube for general use that has not been subjected to complex processing. Namely, an original tube with a circular cylindrical shape (a round tube) is processed, at its opposite ends, into a tip-end tapered shape, such that it has an air exhaust tube (an exhaust tube), and a discharge gas is enclosed therein through the exhaust tube. Further, tip-off sealing processing is performed thereon to form it into a discharge tube. Accordingly, it is possible to reduce burdens and costs for processing thereof, in comparison with structures employing discharge tubes having flat and rectangular cylindrical shapes.

Further, as dielectric-barrier discharge gases, it is possible to employ rare gases such as xenon (Xe), argon (Ar), krypton (Kr), and halogen gases such as fluorine ($F_2$), chlorine ($Cl_2$), and the like. The dielectric barrier discharge lamp 1 emits excimer light varying in wavelength (172 nm, 222 nm, 308 nm, or the like) depending on the species of the gas. For example, in order to clean electronic components, namely in order to decompose organic compounds adhering to electric components, excimer light having a central wavelength of 172 nm is used. Accordingly, in this case, a gas containing xenon (Xe) is employed. Further, the gas enclosing pressure is not particularly limited, but the gas is generally enclosed at a pressure of about 10 to 80 kPa.

(2) The Side-Surface Electrodes

Each side-surface electrode 5 is a member (an example of a beam member) having a rod shape having substantially the same length of the discharge tube 3 (see FIG. 6). The material of the side-surface electrodes 5 may be any conductive material such as an aluminum alloy, stainless steels (SUS) or brass, but is preferably an aluminum alloy in view of the cost and the workability. Further, each side-surface electrode 5 can be fabricated through extrusion or cutting. Further, each side-surface electrode 5 is provided, on its surface, with an oxide film formed through alumite processing. The alumite processing has not been performed on screw holes 5C in the end surfaces 5D of the side-surface electrodes 5, in order to ensure electric conduction therethrough.

Further, as shown in FIG. 7, the pair of the side-surface electrodes 5A and 5B are placed at positions which sandwich the discharge tube 3 therebetween in the forward and rearward directions. More specifically, the pair of the side-surface electrodes 5A and 5B are placed such that the straight lines which connect their respective positions to the center axis O of the discharge tube 3 form an angle θ1 of about 180 degrees.

Further, as shown in FIG. 7, the inner surface 11 of each side-surface electrode 5 which faces the discharge tube 3 is adapted to form a curved surface with substantially the same curvature of the outer surface of the discharge tube 3. Further, it is preferred that the curvature of the inner surfaces 11 is equal to or less than that of the discharge tube 3. The reasons are as follows. If the curvature of the inner surfaces 11 is larger than that of the discharge tube 3, the sputtering induced between the members 3 and 11 easily leaks to outside. This may cause metal films and the like having been induced by such sputtering to adhere to the light extraction area 3A, thereby reducing the light transmittance of this light extraction area 3A. On the contrary, by making the curvature of the inner surfaces 11 equal to or less than that of the discharge tube 3, it is possible to suppress leakages of sputtering to the outside.

Further, in each side-surface electrode 5, the outer side surface thereof other than the aforementioned inner surface 11 is provided with respective tapered surfaces 13 between the upper surface and the front surface (or rear surface) forming it and between the lower surface and the front surface (or rear surface) forming it. Since these tapered surfaces 13 are formed, it is possible to eliminate angular portions from the respective side-surface electrodes 5, thereby suppressing occurrence of corona discharge at their outer side surfaces. Furthermore, by forming their entire outer side surfaces to have a curved-surface shape, it is possible to suppress corona discharge more effectively.

(3) Reflective Film

Out of the two portions of the discharge tube 3 which are sandwiched between the electrodes 5A and 5B, the lower portion is defined as the light extraction area 3A, while an insulating reflective film 9 is formed on the outer surface of the upper portion. As the reflective film 9, it is possible to use a well-known film, such as a dielectric multi-layer film or a reflective film formed by sintering insulating fine particles, for example.

(4) The Holding Blocks

Figure 8:
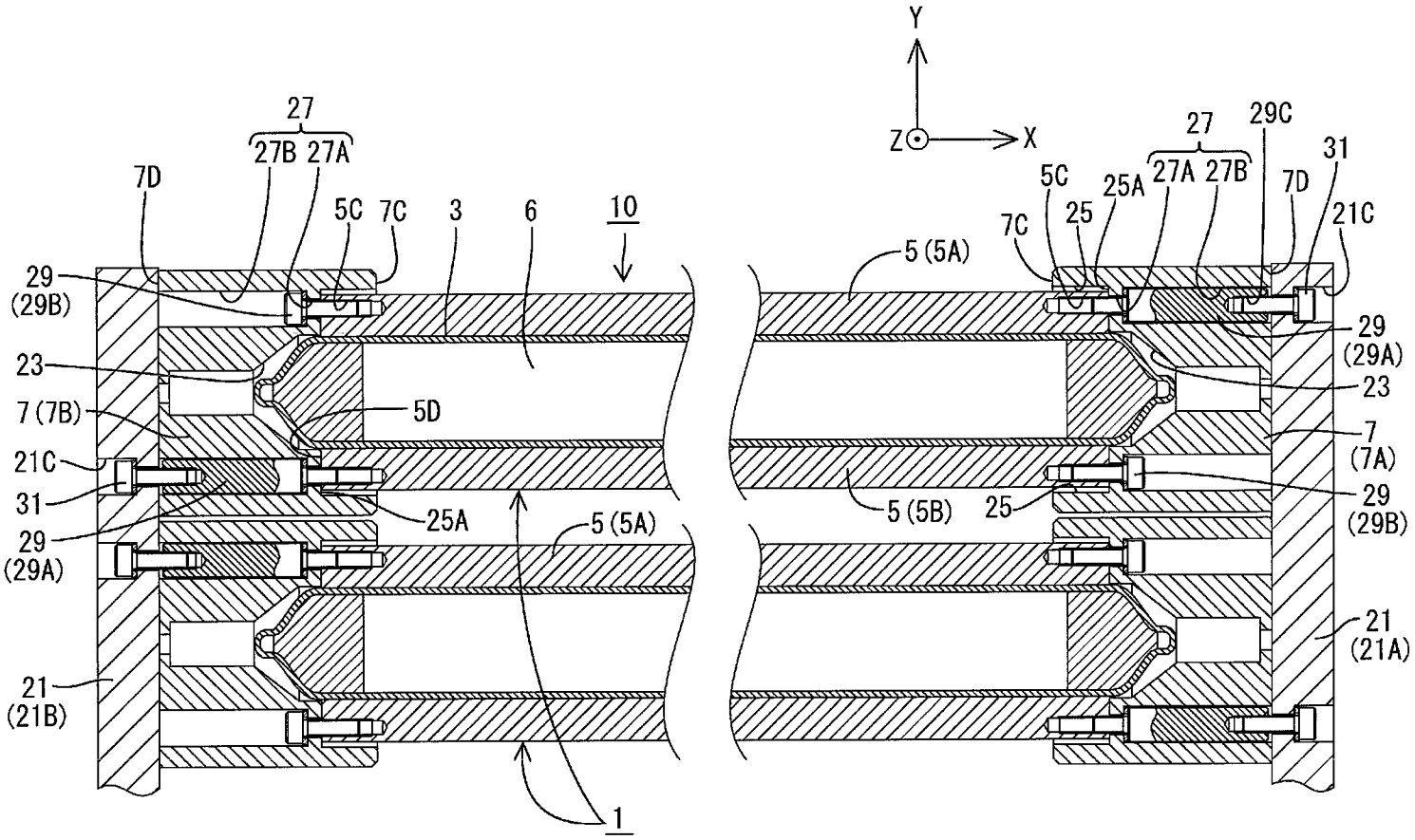
FIG. 8 is a cross-sectional view taken along the line C-C in FIG. 6.
Figure 9:
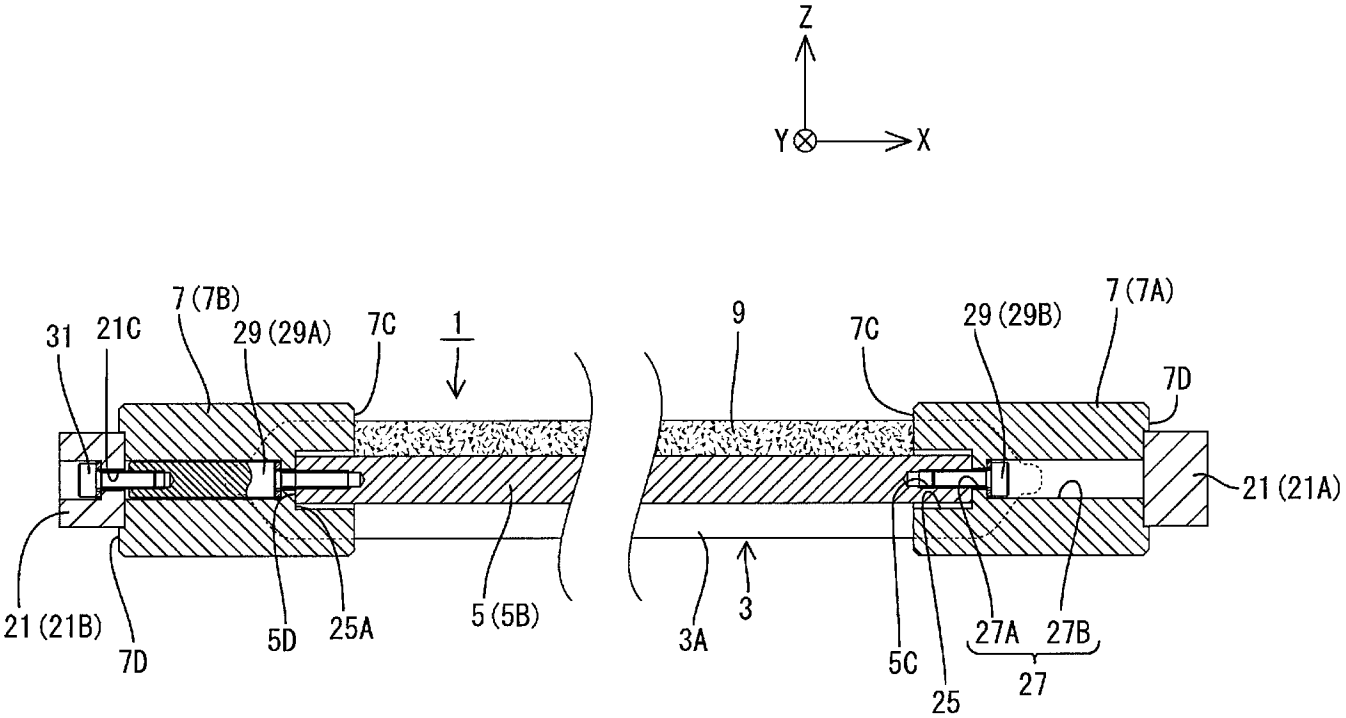
FIG. 9 is a cross-sectional view taken along the line A-A in FIG. 6.

FIG. 8 is a cross-sectional view taken along the line C-C in FIG. 6. FIG. 9 is a cross-sectional view taken along the line A-A in FIG. 5. However, FIGS. 8 and 9 are different from FIGS. 5-7 in that there are illustrated only two aforementioned dielectric barrier discharge lamps, and there are illustrated the aforementioned feeding members 21 and 21 for coupling them to each other. A pair of holding blocks 7, 7 are placed to hold respective end portions of the discharge tube 3, as shown in FIG. 5-6. Hereinafter, both the holding blocks 7, 7 will be referred to as "a holding block 7A and a holding block 7B", when they are distinguished from each other.

Each holding block 7 is made of an insulating material, such as ceramic. Each holding block 7 has a rectangular-parallelepiped shape in its entirety, and is provided, in its facing surface 7C facing the discharge tube 3, with a discharge-tube housing portion 23 and a pair of electrode housing portions 25. The discharge-tube housing portion 23 is a concave portion having a circular-shaped cross section which conforms to the outer shape of the discharge tube 3, and is thus enabled to house an end portion of the discharge tube 3. Further, the discharge-tube housing portion 23 is formed to have a tip-end tapered shape at its back side, such that it conforms to the shape of the end portion of the discharge tube 3.

The pair of electrode housing portions 25 are placed such that they sandwich the discharge-tube housing portion 23 therebetween, at front and rear sides. Respective electrode housing portions 25 are concave portions having a substantially rectangular-shaped cross section which conforms to the outer shape of the side-surface electrodes 5 and are thus enabled to house respective end portions of the side-surface electrodes 5. Further, in the back surface 25A of each electrode housing portion 25, there is formed a through hole 27 which reaches a non-facing surface 7D of the holding block 7 in the opposite side from the above facing surface 7C. The through hole 27 extends in the leftward and rightward directions of the discharge tube 3 and is constituted by a screw-insertion portion 27A closer to the electrode housing portion 25 and a larger-diameter portion 27B having a larger diameter than the screw-insertion portion 27A.

On the other hand, each side-surface electrode 5 is provided with the screw holes 5C in its end surfaces 5D. Further, as shown in FIG. 8, the holding blocks 7A and 7B are fitted to the respective end portions of the discharge tube 3 and the side-surface electrodes 5, and screws 29 inserted through the through holes 27 are screwed, at their screw portions, into the screw holes 5C in the side-surface electrodes 5, through the screw insertion portions 27A. Thus, the pair of side-surface electrodes 5, 5 have the function of protecting the discharge tube 3 as beams for coupling the holding blocks 7A and 7B to each other, while sandwiching the discharge tube 3 therebetween, so that the discharge tube 3 and the pair of the side-surface electrodes 5, 5 are integrated.

(5) The Structure for Suppressing the Rotation of the Discharge Tube

The side-surface electrodes 5 can be bonded to the discharge tube 3 through vapor deposition or the like, but, in this embodiment, the discharge tube 3 and the side-surface electrodes 5 are not bonded to each other, in order to reduce the working burdens and the cost increase due to such vapor deposition or the like. Therefore, the discharge tube 3 may be rotated with respect to the side-surface electrodes 5 due to, for example, vibrations and the like. In this case, if they are allowed to rotate with respect to each other, the portions of the discharge tube 3 which have been contaminated by discharge induced between the discharge tube 3 and edge portions of the side-surface electrodes 5 may form portions of the light extraction area 3A, thus resulting in reduction of the light transmittance of these light extraction area 3A.

Hence, in this embodiment, the dielectric barrier discharge lamp 1 is provided with a structure of suppressing the rotations of the discharge tube 3. More specifically, as shown in FIGS. 5 & 7, the discharge tube 3 is provided with convex portions 3B (an example of an engagement portion) at its portions closer to the end portions. On the other hand, the holding blocks 7 are provided with concave portions 7E (cut-out portions in the same figures, an example of a to-be-engaged portion) which can engage with the convex portions 3B. Further, due to the engagement between the portions 3B and 7E, the discharge tube 3 can be inhibited from rotating about the side-surface electrodes 5.

(6) The Structure for Reducing the Areas in which the Discharge Tube and the Side-Surface Electrodes are not in Contact with Each Other.

Figure 10A:
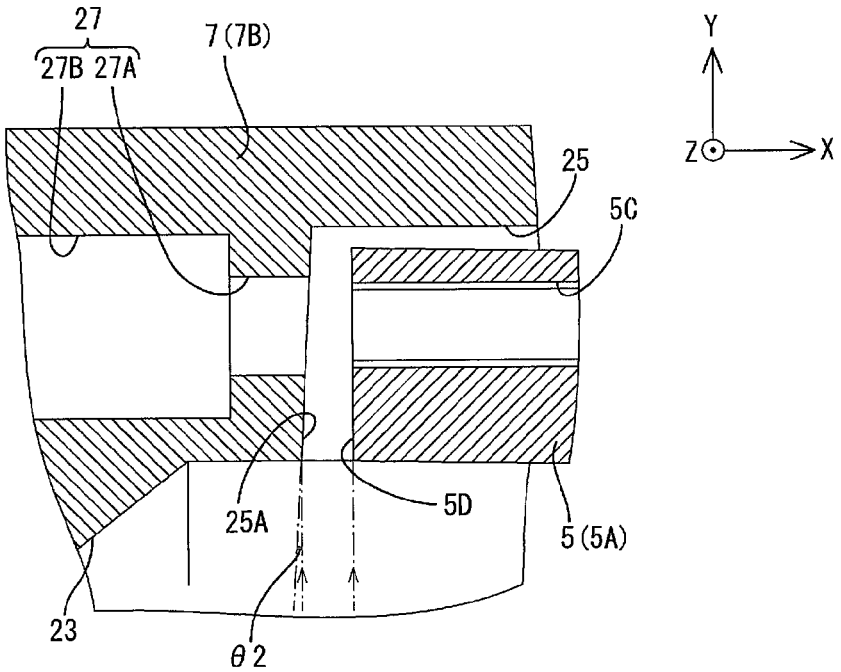
FIG. 10A is an enlarged view illustrating a side-surface electrode and a holding block when they have not been coupled to each other.
Figure 10B:
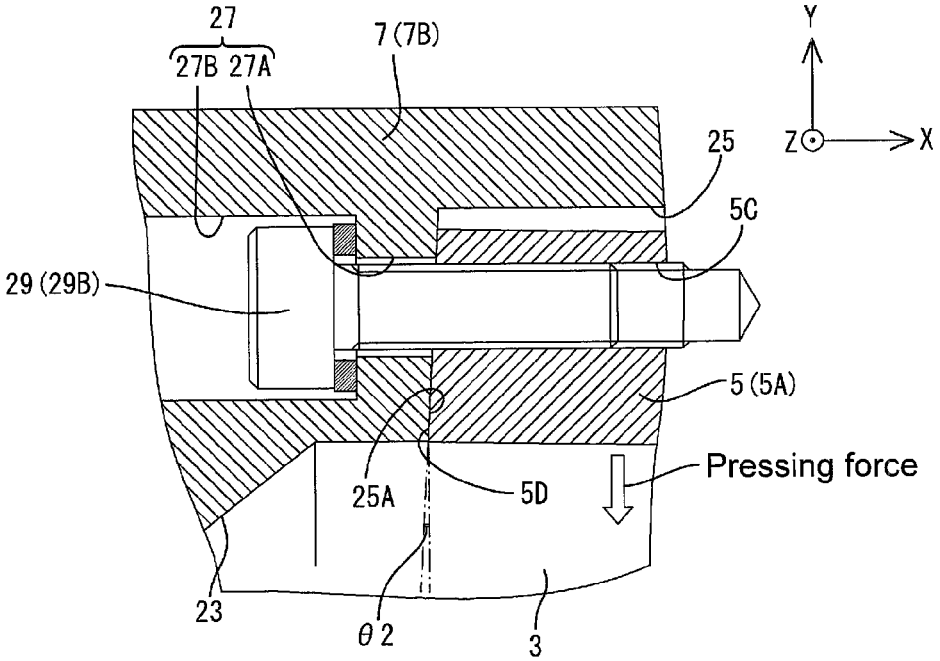
FIG. 10B is an enlarged view illustrating the side-surface electrode and the holding block when they have been coupled to each other.

FIG. 10A is an enlarged view illustrating a side-surface electrode 5 and a holding block 7 which have not been coupled to each other, and FIG. 10B is an enlarged view illustrating the electrode 5 and the block 7 which have been coupled to each other.

As described above, since the discharge tube 3 and the side-surface electrodes 5 are not bonded to each other, there may be larger areas in which the members 3 and 5 do not contact with each other. This tends to induce discharge between the members 3 and 5, when a voltage is applied to the side-surface electrodes 5. Such discharge may degrade the discharge tube 3 and the side-surface electrodes 5 and shorten their lives.

Therefore, when the side-surface electrodes 5 and the holding blocks 7 have not been coupled to each other, the back surfaces 25A of the electrode housing portions 25 and the end surfaces 5D of the side-surface electrodes 5 form different angles with respect to the forward and rearward direction (the direction of the arrangement of the side-surface electrodes 5A and 5B, the direction perpendicular to the longitudinal direction of the discharge tube). Thus, as they are coupled to each other by the screws 29, the side-surface electrodes 5 are caused to be pressed against the discharge tube 3.

In the example illustrated in FIG. 10A, the end surface 5D of the side-surface electrode 5A is substantially parallel with the forward and rearward direction, while the back surface 25A of the electrode housing portion 25 is inclined with respect to the forward and rearward direction in such a way to slightly face toward the discharge-tube housing portion 23. Hence, when the side-surface electrode 5A and the housing block 7B have been coupled to each other by the screw 29, a force warping the side-surface electrode 5A toward the discharge tube 3 is induced between the surfaces 5D and 25A, thereby causing the side-surface electrode 5A to be pressed against the discharge tube 3. This can reduce the aforementioned non-contacted areas. Further, as another example, the end surface 5D of the side-surface electrode 5A may be inclined with respect to the forward and rearward direction in such a way to slightly face toward the discharge housing portion 23, while the back surface 25A of the electrode housing portion 25 is substantially parallel with the forward and rearward direction.

3. The Structure of the Feeding Members

As shown in FIG. 8, the plural dielectric barrier discharge lamps 1 are arranged in the forward and rearward directions and can be integrated by the rod-shaped feeding members 21, 21. Hereinafter, the feeding members 21, 21 are referred to as "a feeding member 21A and a feeding member 21B", when they are distinguished from each other.

As shown in FIGS. 3-4, each feeding member 21 is a flat and rod-shaped member extending in the forward and rearward directions. The material of the same may be any conductive material such as an aluminum alloy, stainless steels (SUS) or brass, but is preferably an aluminum alloy in view of the cost and the workability. The feeding member 21A is electrically connected to a high-voltage terminal (an example of a first power-supply terminal, not shown) in a power supply device for applying AC voltages thereto and also functions as a first support member 21A to comprehensively support the holding blocks 7A in the plural dielectric barrier discharge lamps 1. The other feeding member 21B is electrically connected to an earth terminal (an example of a second power-supply terminal, not shown) in the power supply device, and also functions as a second support member 21B to comprehensively support the holding blocks 7B in the plural dielectric barrier discharge lamps 1.

More specifically, the above screws 29 are constituted by two types of screws, which are first screws 29A with a longer head portion, and second screws 29B with a shorter head portion, wherein at least the first screws 29A are made from a conductive material. Each first screw 29A is provided with a screw hole 29C in its head portion.

In a side-surface electrode 5A, the first screw 29A is screwed into its one end surface 5D (the right end surface), and a screw 31 inserted through a screw insertion hole 21C formed in the feeding member 21A is screwed into the head portion of the first screw 29A. Thus, the side-surface electrode 5A and the feeding member 21A are electrically connected. Further, in the side-surface electrode 5A, the second screw 29B is screwed into the other end surface 5D thereof (the left end surface), and the second screw 29B and the feeding member 21B are spaced apart. Therefore, the side-surface electrode 5A and the feeding member 21B are electrically insulated from each other.

On the contrary, in the side-surface electrode 5B, the second screw 29B is screwed into its one end surface 5D (the right end surface), and is spaced apart from the feeding member 21A. Therefore, the side-surface electrode 5B is electrically insulated from the feeding member 21A. Further, in the side-surface electrode 5B, the first screw 29A is screwed into the other end surface 5D thereof (the left end surface), and a screw 31 inserted through a screw insertion hole 21C formed in the feeding member 21B is screwed into the head portion of the first screw 29A. Hence, the side-surface electrode 5B is electrically connected to the feeding member 21B. As described above, the side-surface electrode 5A is directly coupled to the feeding member 21A, and is indirectly coupled to the feeding member 21B via the holding blocks 7B. Furthermore, the side-surface electrode 5B is directly coupled to the feeding member 21B, and is indirectly coupled to the feeding member 21A through the holding blocks 7A.

Further, the side-surface electrode 5A is connected to the above high-voltage terminal in the power supply device via the feeding member 21A, while the side-surface electrode 5B is connected to the earth terminal via the feeding member 21B. Further, in two dielectric barrier discharge lamps 1, 1 neighboring to each other, the side-surface electrodes 5A and 5B facing each other are commonly connected to one of the feeding member 21A and the feeding member 21B. In FIG. 8, the side-surface electrode 5B in the dielectric barrier discharge lamp 1 in the front side and the side-surface electrode 5A in the dielectric barrier discharge lamp 1 in the rear side are connected to the feeding member 21B. Further, the side-surface electrode 5B in the dielectric barrier discharge lamp 1 in this rear side and the side-surface electrode 5A in the dielectric barrier discharge lamp (not shown) in the subsequently-rear side are connected to the feeding member 21A. This can prevent occurrence of short circuits between the electrodes 5A and 5B, in a structure in which one side-surface electrode 5A and the other side-surface electrode 5B, out of two side-surface electrodes facing each other, are connected to the feeding member 21A and the feeding member 21B, respectively. This enables placing the respective dielectric barrier discharge lamps 1 proximally to each other.

4. Effects of this Embodiment

In this embodiment, the pair of the side-surface electrodes 5, 5 are placed on the outer peripheral surface of the discharge tube 3 such that the light extraction area 3A is positioned between the electrodes 5, 5 in the peripheral direction of the outer peripheral surface thereof. Therefore, no electrode is present in the light extraction area 3A. Accordingly, it is possible to increase the light transmittance, in comparison with the conventional structures employing mesh electrodes placed in light extraction areas.

Further, in cases where the to-be-treated objects (e.g., glass substrates of liquid crystal display panels) are optically cleaned using the dielectric barrier discharge lamps, the light extraction areas may be contaminated by the mist in the atmosphere or the gas induced from the to-be-treated objects due to decomposition, thus degrading the light transmittance of the light extraction areas. Therefore, there is a need to remove such contaminations. However, for a conventional structure described in Patent Document 1 (the conventional structure), it is hard to remove contaminations in the light extraction area due to the obstruction of the mesh electrode. On the contrary, with the dielectric barrier discharge lamps 1 of this embodiment, no electrode exists in the light extraction areas 3A, so the contaminations in the light extraction areas 3A can be easily removed.

Further, with the conventional structure, as voltages are applied to the electrodes, sputtering may be induced in the mesh electrode. This may cause a metal film to adhere to the surface of the discharge tube, thus degrading the light transmittance of the light extraction area. On the contrary, with the dielectric barrier discharge lamps 1 of this embodiment, since no electrode is present in the light extraction areas 3A, even if sputtering occurs at the side-surface electrodes 5, it is possible to suppress adhesion of a metal film to the light extraction areas 3A, thereby suppressing the degradation of the light transmittance of the light extraction areas 3A.

Further, in cases of employing mesh electrodes as in the conventional structure, there is a need for labor and costs for forming them on the discharge tubes. However, in this embodiment, no mesh electrode is used, so such labor and costs can be reduced. Also, with the conventional structure, the mesh electrode formed in the light extraction area may be broken by, for example, its contact with the to-be-treated object, which may make it impossible to use the dielectric barrier discharge lamp itself. However, with this embodiment, it is possible to suppress the occurrence of such accidents.

Further, in this embodiment, the discharge tubes 3 are provided with the convex portions 3B (engagement portions)

and the holding blocks 7 provided with the concave portions 7E (to-be-engaged portions). Therefore, due to the engagement between the engagement portions and the to-be-engaged portions, it is possible to prevent rotations of the electrodes 5 and the discharge tubes 3 with respect to each other, thus suppressing the reduction of the light transmittance in the light extraction areas 3A.

Further, in this embodiment, the plural dielectric barrier discharge lamps are integrated by the feeding members 21 (support members) and side-surface electrodes 5 (beam members), in a state where they are placed in parallel. This can improve the usability of the plural dielectric barrier discharge lamps 1, for example, in such a way to use them as a flat-surface lamp at a predetermined installation place, while enabling comprehensively extracting them from the installation place for replacement operations.

Further, in this embodiment, the pair of the holding blocks 7, 7 are adapted to hold respective end portions of the discharge tube 3, and the side-surface electrodes 5, 5 that are rod-shaped members are adapted to couple the pair of the holding blocks 7, 7 to each other, and hence have the function of protecting the discharge tube 3, as structural members (beams). This can reduce the number of members, in comparison with the structures provided with additional structural members besides the electrodes. Further, since the side-surface electrodes 5 are constituted by such rod-shaped electrodes, they have a larger cross-sectional area than the mesh electrodes and the like, and therefore have a lower impedance that can reduce electric power losses in the electrodes.

In addition, in this embodiment, an insulating reflective film 9 is formed between the side-surface electrodes 5, 5 at a portion other than the light extraction area 3A. This eliminates the necessity of providing additional reflection plates. Further, because the reflective film 9 has an insulating property, it is possible to prevent short circuits between the side-surface electrodes 5, 5.

(Second Embodiment)

Figure 11A:
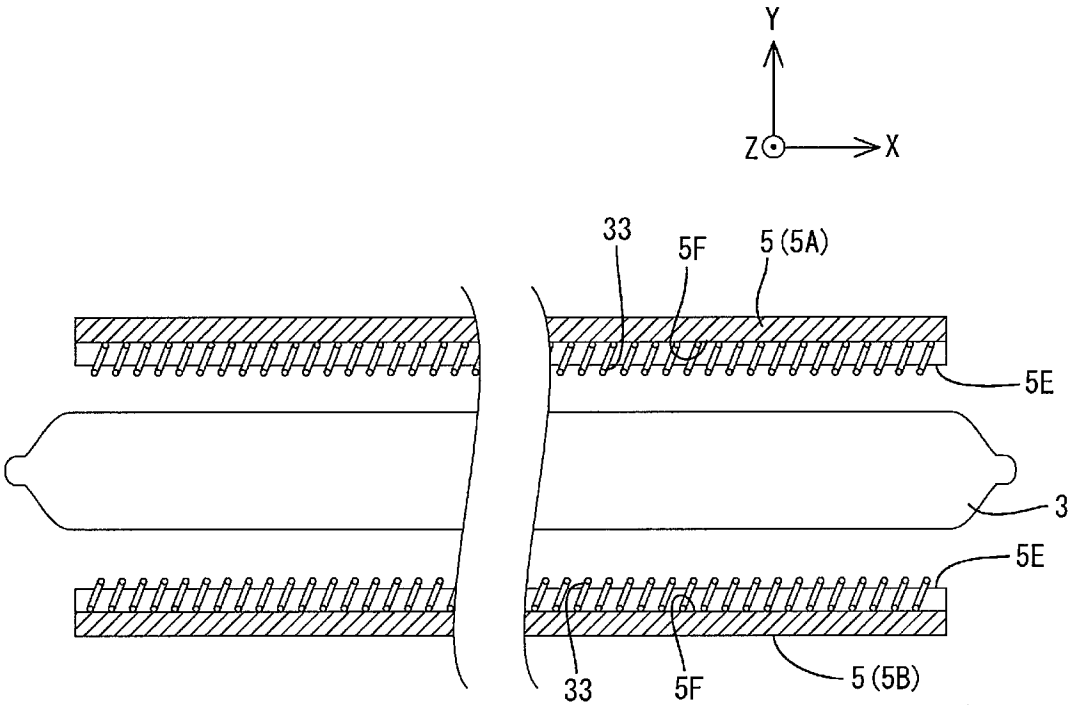
FIG. 11A is a schematic view illustrating a discharge tube and side-surface electrodes according to a second embodiment when the side-surface electrodes have not been coupled to holding blocks.
Figure 11B:
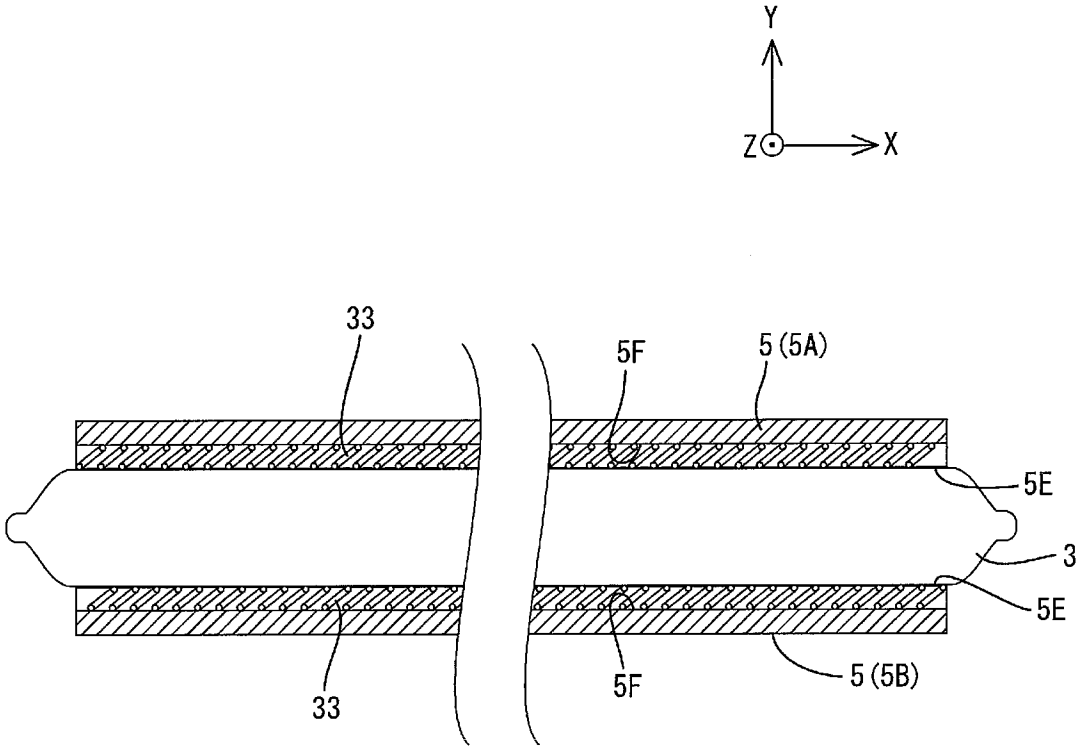
FIG. 11B is a schematic view illustrating the discharge tube and the side-surface electrodes when the side-surface electrodes have been coupled to the holding blocks.

FIGS. 11A and 11B illustrate a second embodiment, which is different from the above first embodiment in the method for bringing a discharge tube 3 and side-surface electrodes 5 into contact with each other, but the other parts are the same as those of the above first embodiment. Accordingly, hereafter, the second embodiment is described regarding only the difference therein, by omitting redundant description and by using the same reference characters as those of the first embodiment.

FIG. 11A is a schematic view illustrating a discharge tube 3 and side-surface electrodes 5, when the latter have not been coupled to holding blocks 7. FIG. 11B is a schematic view illustrating the discharge tube 3 and the side-surface electrodes 5, when the latter and the holding blocks 7 have been coupled to each other.

In this embodiment, conductive cushion members (elastic members) are inserted between the discharge tube 3 and the side-electrode electrodes 5, in a state where these cushion members are elastically deformed. Specifically, the side-surface electrodes 5 are provided with slots 5F in the leftward and rightward direction in their surfaces 5E facing the discharge tube 3, and coil springs 33 (an example of a cushion member) are inserted in the slots 5F (see FIG. 11A).

Further, when the side-surface electrodes 5 and the holding blocks 7 have been coupled to each other, the coil springs 33 are compressed and deformed by being sandwiched between the discharge tube 3 and the side-surface electrodes 5. This can reduce the areas in which the members 3 and 5 do not contact with each other. Further, it is also possible to employ steel wires or conductive rubbers instead of coil springs 33.

In this embodiment, it is possible to reduce the areas in which the discharge tube 3 and the side-surface electrodes 5 do not contact with each other due to the coil springs 33, which can suppress the occurrence of discharge between the discharge tube 3 and the side-surface electrodes 5 when a voltage is applied to the side-surface electrodes 5.

(Third Embodiment)

Figure 12A:
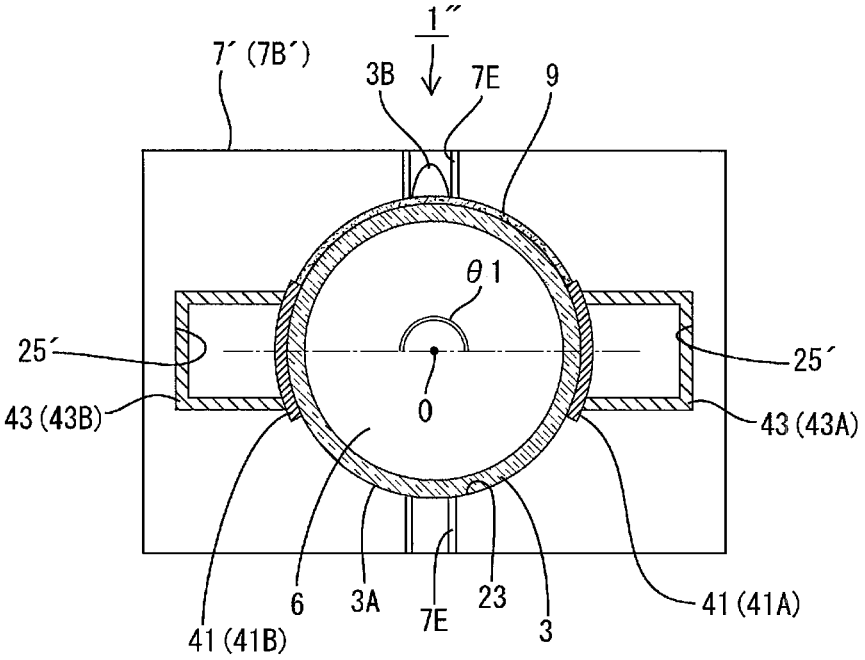
FIG. 12A is a cross-sectional view of a dielectric barrier discharge lamp according to a third embodiment.
Figure 12B:
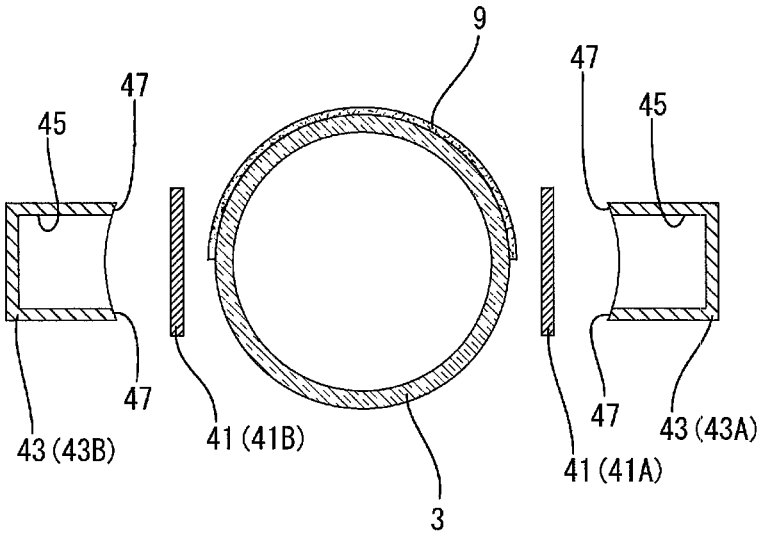
FIG. 12B is an exploded view of a discharge tube, electrodes and beam members.

FIGS. 12A-12B illustrate a third embodiment, which is different from the above first embodiment in the structure of the electrodes and the beam structures for protecting a discharge tube 3, but the other parts are the same as those of the first embodiment. Accordingly, hereafter, the third embodiment is described regarding only the difference, by omitting redundant description and by using the same reference characters.

FIG. 12A is a cross-sectional view of a dielectric barrier discharge lamp 1 of this embodiment, when it is viewed in the leftward and rightward direction. FIG. 12B is an exploded view of a discharge tube 3, a pair of electrodes 41, 41 and a pair of beam members 43, 43 when they have not been combined to each other. Hereinafter, the electrodes 41, 41 are referred to as "an electrode 41A and an electrode 41B", when they are distinct from each other, and the beam members 43, 43 are referred to as "a beam member 43A and a beam member 43B" when they are distinct from each other.

Each electrode 41 is constituted by a flat spring having a flat-plate shape which extends in the leftward and rightward direction of the discharge tube 3. The material thereof may be any conductive material such as phosphor bronze, stainless steel or beryllium copper, but the material thereof is particularly preferably a material having excellent corrosion resistance. In this embodiment, flat springs with a thickness of about 0.03 mm which are made of a stainless steel are employed.

Each beam member 43 is constituted by a rod-shaped member extending in the leftward and rightward direction of the discharge tube 3. More specifically, each beam member 43 is provided with a slot 45 along the leftward and rightward direction, in its surface facing the outer peripheral surface of the discharge tube 3. Thus, each beam member 43 has a cross section having a substantially "C" shape (an angular "C" shape) when it is viewed in the leftward and rightward direction. Further, when each beam member 43 is made of a stainless steel, there is no need for applying alumite processing thereon. For example, by employing general-purpose C channels, which have been used for holding mirrors and the like, it is possible to further reduce the cost thereof.

A pair of holding blocks 7', 7' are provided with electrode housing portions 25', 25' which conform to the cross-sectional shapes of the end portions of the respective beam members 43 in the leftward and rightward directions. Further, as shown in FIG. 12B, each beam member 43 is placed such that each electrode 41 is sandwiched between it and the discharge tube 3, and its respective end portions in the leftward and rightward directions are housed in and coupled to the electrode housing portions 25' in the pair of the holding blocks 7', 7'. Further, preferably, each beam member 43 is made of a conductive stainless steel and is adapted to be closed at its respective end portions and to be secured to the respective holding blocks 7' by screws 29A and 29B similar to those in the above first embodiment, so that the respective electrodes 41 are electrically connected to respective feeding members 21.

Further, since the respective beam members 43 are coupled to the pair of the holding blocks 7', 7', respective electrodes 41 are pressed against the outer peripheral surface of the discharge tube 3 by the respective beam members 43. More specifically, the respective electrodes 41 are pressed against the opening ends of the beam members 43 (the opposite edges of the slots 45), so that they are curved into a U shape such that they conform to the outer peripheral surface of the discharge tube 3 (FIG. 12A). This can certainly bring each electrode into contact, at its upper and lower opposite edges, with the outer peripheral surface of the discharge tube 3. Further, the beam members 43 themselves function as structural members, so the electrodes do not need a strength as high as those described in the aforementioned first and second embodiments.

(Fourth Embodiment)

Figure 13:
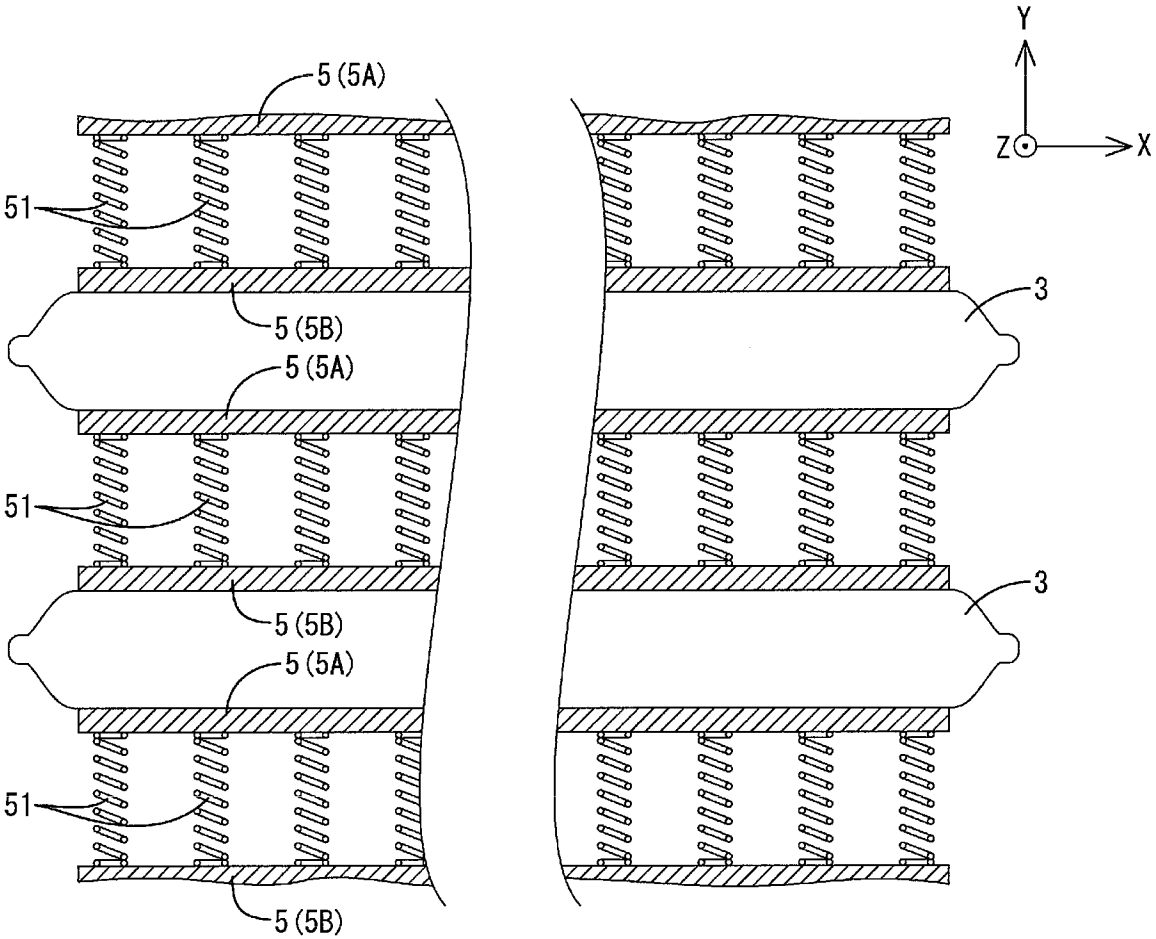
FIG. 13 is a top view schematically illustrating discharge tubes and side-surface electrodes in respective dielectric barrier discharge lamps 1 according to a fourth embodiment.

FIG. 13 illustrates a fourth embodiment, which is different from the above first embodiment in the method of pressing electrodes against discharge tubes, but the other parts are the same as those of the above first embodiment. Accordingly, hereafter, the fourth embodiment is described regarding only the difference, by omitting redundant description and by using the same reference characters as those of the first embodiment.

FIG. 13 is a top view schematically illustrating discharge tubes 3 and side-surface electrodes 5 in the respective dielectric barrier discharge lamps 1. As shown in the same figure, between two dielectric barrier discharge lamps 1, 1 neighboring to each other, there are placed coil springs 51 (an example of a biasing member) for biasing the side-surface electrodes 5A and 5B facing each other, in such directions that they get away from each other, in a state where they are being compressed and deformed.

In this embodiment, the respective side-surface electrodes 5 are pressed against the outer peripheral surfaces of the discharge tubes 3, due to the repulsive forces (biasing forces) of the coil springs 51. This can reduce the areas in which the side-surface electrodes 5 and the discharge tubes 3 are not in contact with each other, which can suppress the occurrence of discharge between the discharge tubes 3 and the side-surface electrodes 5 when the discharge tubes 3 are lighted.

(Fifth Embodiment)

Figure 14:
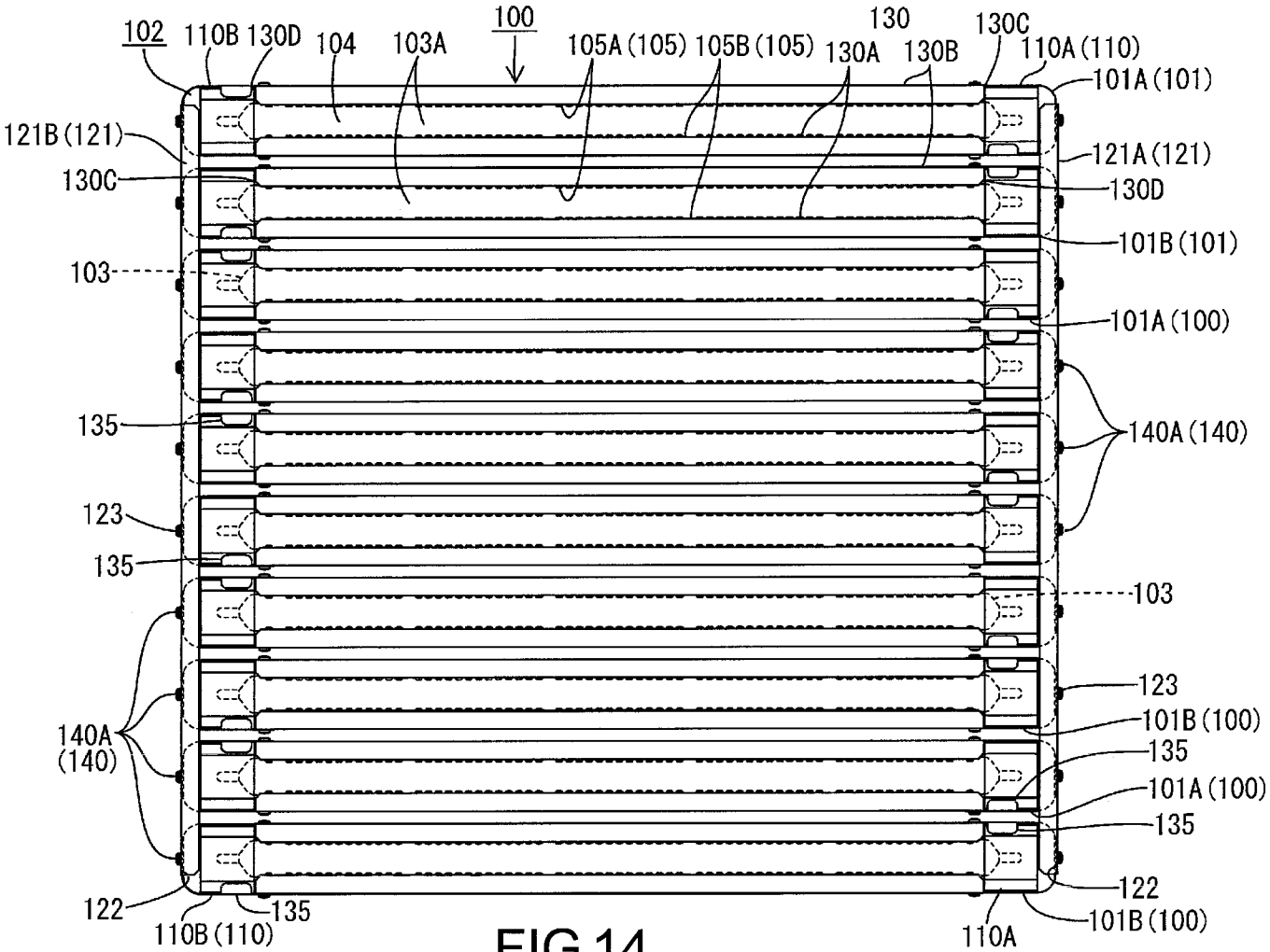
FIG. 14 is a bottom view of a lamp unit according to a fifth embodiment.

A fifth embodiment of this invention is described referring to FIGS. 14-18. FIG. 14 is a bottom view illustrating a lamp unit 100 of this embodiment from its lower side. As shown in FIG. 14, the lamp unit 100 includes plural (e.g., ten) dielectric barrier discharge lamps 101 integrated in a state of being arranged in parallel in the forward and rearward directions. More specifically, the lamp unit 100 is structured to include a dielectric barrier discharge lamp arrangement 102 formed by the above plural dielectric barrier discharge lamps 101 arranged in parallel, and a pair of feeding members 121, 121 (an example of a first support member 121A and a second support member 121B).

As shown in FIG. 14, the dielectric barrier discharge lamp arrangement 102 is structured to include the plural dielectric barrier discharge lamps 101 that are arranged such that the contact pieces 135 (described in details later) in adjacent dielectric barrier discharge lamps 101 are adjacent to each other (each dielectric barrier discharge lamp 101 having a contact piece 135 in its lower right side in FIG. 14 will be designated as 101A, while each dielectric barrier discharge lamp 101 having a contact piece 135 in its upper right side in the same figure will be designated as 101B).

Figure 15:
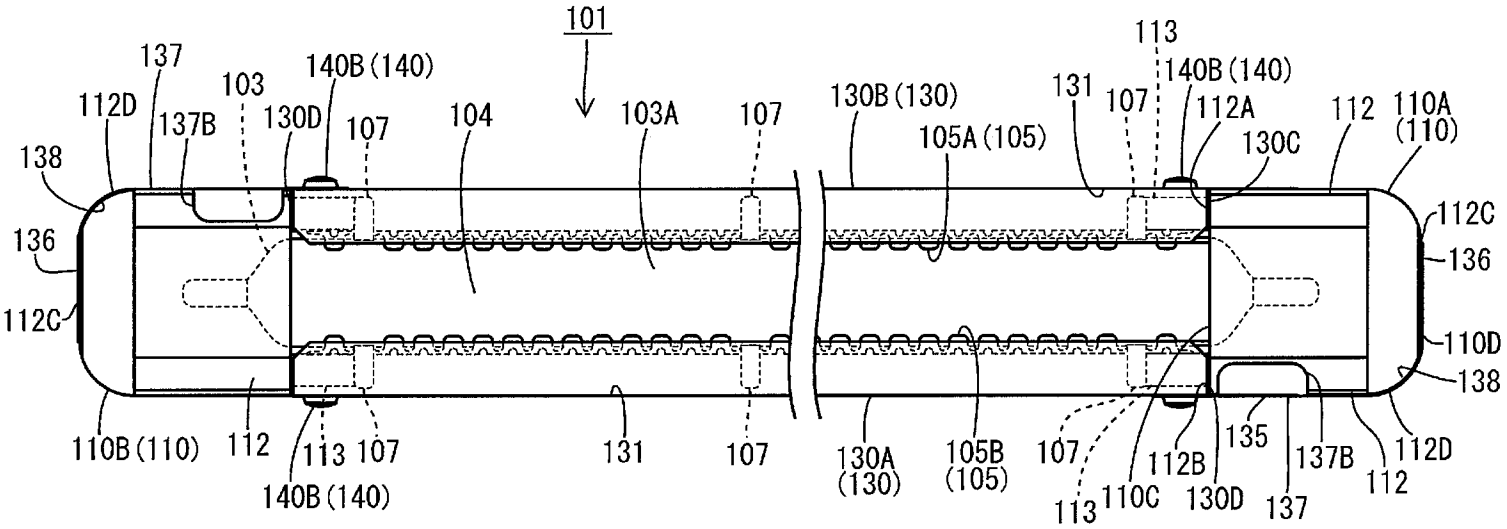
FIG. 15 is a bottom view of a dielectric barrier discharge lamp.
Figure 16:
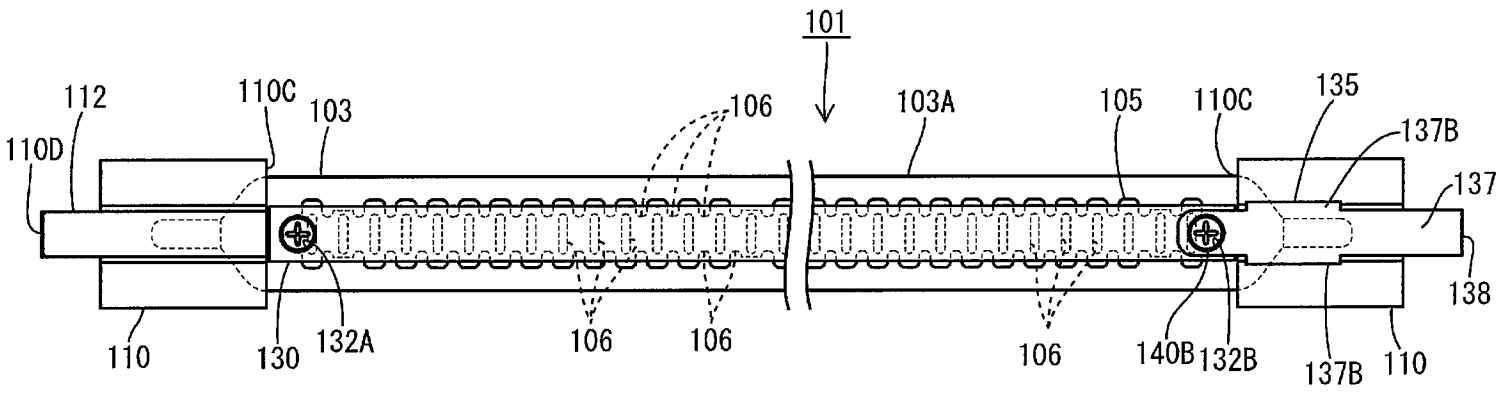
FIG. 16 is a side view of the dielectric barrier discharge lamp.
Figure 17:
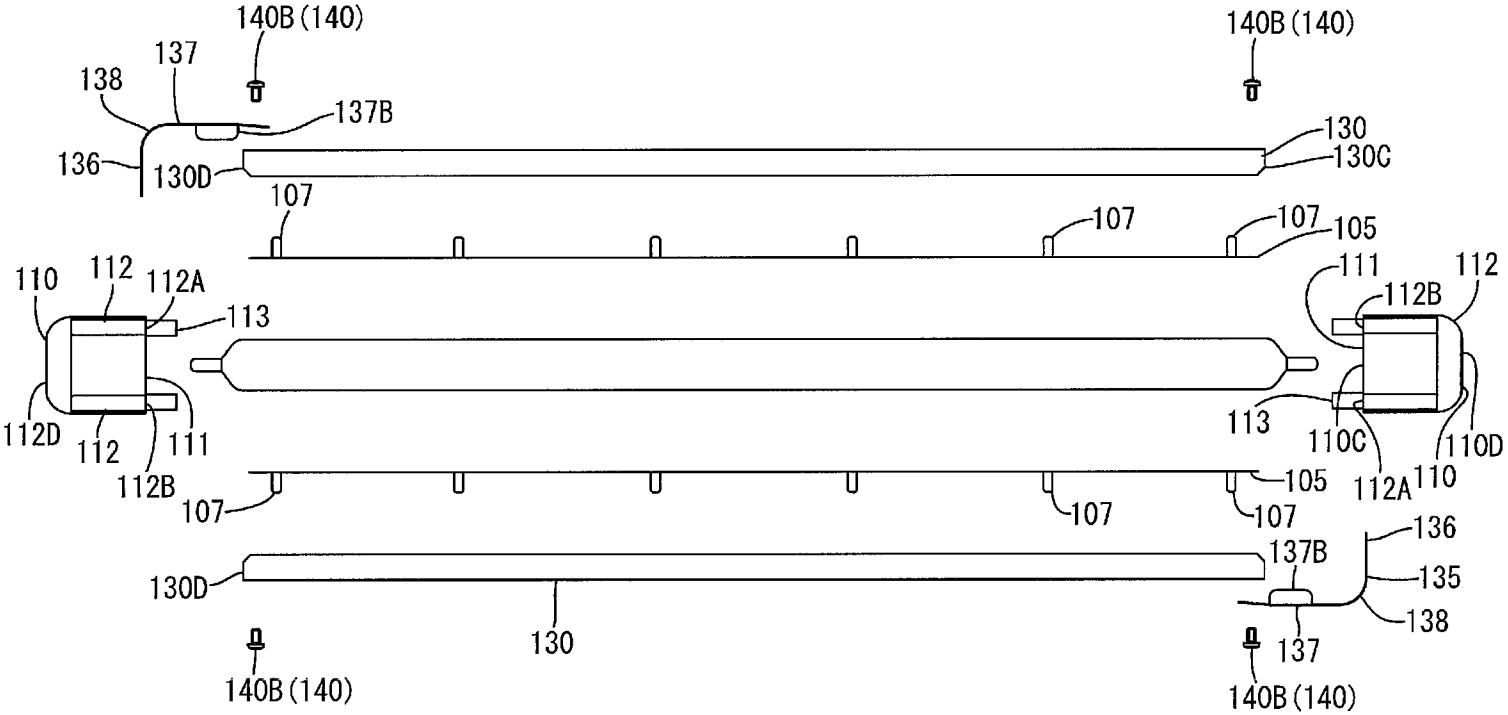
FIG. 17 is an exploded side view of a discharge tube, electrodes and beam members.

A dielectric barrier discharge lamp 101 includes a discharge tube 103, a pair of electrodes 105, 105, a pair of beam members 130, 130, a pair of holding blocks 110, 110, and contact pieces 135 for coupling the beam members 130 and the holding blocks 110 to each other, as shown in FIGS. 15-17. FIG. 15 is a bottom view illustrating a dielectric barrier discharge lamp 101 from its lower side. FIG. 16 is a side view of the dielectric barrier discharge lamp 101. FIG. 17 is an exploded side view of the discharge tube 103, the electrodes 105 and the beam members 130.

In the outer peripheral surface of the discharge tube 103 along the longitudinal direction (the leftward and rightward directions in FIG. 15), its lower-surface side is defined as a light extraction area 103A for extracting light induced within the discharge tube 103 to outside, while an insulating reflective film (not shown) is formed on the outer surface of its upper portion. The pair of electrodes 105, 105 are placed on the outer peripheral surface of the discharge tube 103 such that the light extraction area 103A is positioned between the electrodes 105, 105, in the peripheral direction of the outer peripheral surface thereof. Hereafter, the electrodes 105, 105 in the opposite side surfaces are referred to as "an electrode 105A and an electrode 105B" when they are distinct from each other. Further, the reflective film has the same structure as that in the above first embodiment. In FIG. 15, "104" designates a discharge space.

The discharge tube 103 is different from that in the first embodiment, in that it does not include convex portions 3B at its portions closer to the end portions, but the other portions thereof have substantially the same structures as those of the discharge tube 3 in the dielectric barrier discharge lamp 1 according to the first embodiment.

Each electrode 105 is constituted by a flat spring having a flat-plate shape which extends in the longitudinal direction of the discharge tube 103. The material thereof may be any conductive material such as phosphor bronze, stainless steels or beryllium copper, but the material thereof is particularly preferably a material having excellent corrosion resistance. In this embodiment, flat springs with a thickness of about 0.03 mm which are made of stainless steel are employed.

Figure 18:
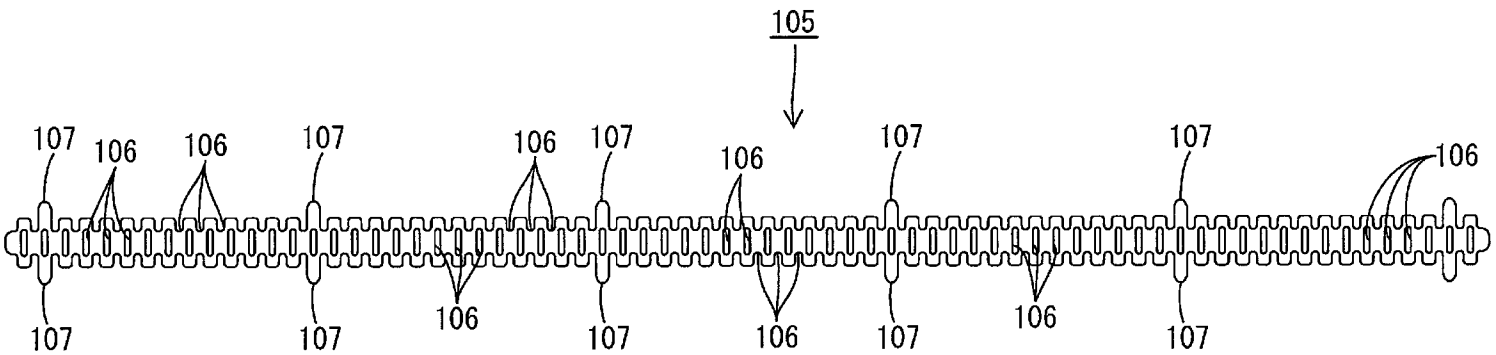
FIG. 18 is a top view of an electrode when displacement prevention protruding portions therein have not been folded.

In this embodiment, as shown in FIG. 18, each electrode 105 is provided with plural slits 106 formed in directions intersecting with the longitudinal direction. The electrodes 105 are provided with a plurality of such slits 106 at their center portions and the edge portions in the longitudinal direction. These slits 106 have the function of releasing heat to prevent deformation of the electrodes 105 due to thermal expansion thereof, when the electrodes 105 are subjected to heat.

Further, in this embodiment, similarly to the third embodiment, the pair of beam members 130, 130 are coupled to the pair of holding blocks 110, 110, so the respective electrodes 105 are pressed against the outer peripheral surface of the discharge tube 103 by the respective beam members 130, 130. This can certainly bring each electrode 105 into contact, at its upper and lower opposite edges, with the outer peripheral surface of the discharge tube 103.

Also, as shown in FIG. 18, each electrode 105 is provided with plural protruding portions 107 formed to protrude in directions (widthwise directions) intersecting with the longitudinal direction. The plural protruding portions 107 are folded substantially perpendicularly and are inserted in slots 131 in the beam members 130, 130, so that the electrodes 105 are combined with the beam members 130, 130 at predetermined positions without being displaced therefrom. Namely, the protruding portions 107 provided in the electrodes 105 prevent displacement of the electrodes 105 (an example of "a displacement prevention protruding portion").

The pair of beam members 130, 130 are constituted by rod-shaped members extending in the longitudinal direction of the discharge tube 103, and are provided with the slots 131 as openings along the longitudinal direction, in their surfaces facing the outer peripheral surface of the discharge tube 103, similarly to the beam members 43 in the third embodiment.

Thus, the beam members 130 in this embodiment also have a cross section having a substantially-C shape, when they are viewed in the leftward and rightward direction. Further, when each beam member 130 is made of a stainless steel, there is no need for applying alumite processing thereon. For example, by employing, as the respective beam members 130, general-purpose C channels which have been used for holding mirrors and the like, it is possible to further reduce the cost thereof.

Each beam member 130 is coupled, at its two end portions 130C and 130D in the longitudinal direction, to the respective holding blocks 110, 110, by screw members 140 (second screw members 140B) screwed thereinto. The two end portions 130C and 130D of each beam member 130 are provided with a first connection hole 132A which is directly connected to the holding block 110 and a second connection hole 132B which is connected to the holding block 110 together with the contact piece 135. Further, the pair of the beam members 130, 130 will be referred to as "a beam member 130A and a beam member 130B" when they are distinguished from each other.

The pair of holding blocks 110, 110 are placed to hold respective end portions of the discharge tube 103, as shown in FIGS. 15-16. Hereinafter, both the holding blocks 110, 110 are referred to as "a holding block 110A and a holding block 110B" when they are distinguished from each other.

Each holding block 110 is made of an insulating material, such as a ceramic. Each holding block 110 has a substantially-circular cylindrical shape in its entirety, and is provided with a discharge-tube housing portion 111, in its facing surface 110C facing the discharge tube 103. The discharge-tube housing portion 111 is a concave portion having a circular-shaped cross section conforming to the outer shape of the discharge tube 103, and thus can house an end portion of the discharge tube 103. Further, the discharge-tube housing portion 111 is formed to have a tip-end tapered shape at its back side, such that it conforms to the shape of the end portion of the discharge tube 103.

Each holding block 110 is provided, on its outer surface, with a connection protruding portion 112 which is formed to protrude in an outward direction and is connected to the connection piece 135 and the feeding member 121. The connection protruding portion 112 is formed to be substantially U-shaped such that it continuously extends from the facing surface 110C of the holding block 110, through the surface 110D (the non-facing surface 110D) in the opposite side from the facing surface 110C, up to the facing surface 110C. One end portion 112A and the other end portion 112B of the connection protruding portion 112 are placed at positions facing each other on the facing surface 110C. A screw member 140 (a first screw member 140A) for coupling the holding block and the feeding member 121 to each other with the connection piece 135 interposed therebetween can be screwed into the non-facing surface 110D of the holding block 110. The portion of the connection protruding portion 112 extending over the non-facing surface 110D is an arc-shaped portion 112D having an arc shape, which allows a bent portion 138 of the connection piece 135 to easily conform thereto.

On the facing surface 110C of each holding block 110, at positions facing each other, there are provided beam mounting portions 113, 113 which are continuous with the end portions 112A and 112B of the connection protruding portion 112 and formed to protrude in the direction toward the center of the discharge tube 103 (the center in FIGS. 15-17), such that the end portions 130C and 130D of the beam members 130 are mounted thereto. Level differences 114 are formed between the beam mounting portions 113 and the connection protruding portion 112, and the end portions 130C and 130D of the beam members 130 can come into contact with the level differences 114 and can be secured thereto. Each beam mounting portion 113 is adapted such that the connection piece 135 and the beam member 130 can be connected thereto through a second screw member 140B screwed thereinto.

The connection pieces 135 are members for coupling the holding blocks 110 and the beam members 130 to each other and for coupling the holding blocks 110 and the feeding members 121 to each other, and are constituted by conductive members having a substantially L shape as shown in FIG. 17. Each connection piece 135 includes a first connection portion 136 which is overlaid on the non-facing surface 110D of the holding block 110 and is connected to the feeding member 121, and a second connection portion 137 which is connected to the beam member 130 mounted to the beam mounting portion 113 in the holding block 110. The bent portion 138 of each connection piece 135 from its first connection portion 136 to its second connection portion 137 is bent to have a (arc) shape conforming to the arc-shaped portion 112D of the holding block 110.

The first connection portion 136 of each connection piece 135 is provided with a screw insertion hole (not illustrated) which allows the first screw member 140A to be inserted therethrough, and the second connection portion 137 of each connection piece 135 is provided with a screw insertion hole (not shown) which allows the second screw member 140B to be inserted therethrough. Further, the second connection portion 137 of each connection piece 135 is provided with a pair of sandwiching pieces 137B and 137B adapted to sandwich the connection protruding portion 112 of the holding block 110 in the widthwise direction.

A single connection piece 135 is mounted to a single holding block 110. More specifically, the connection piece 135 is mounted to the beam member 130A for the holding block 110A in the right side in FIG. 15, while being mounted to the beam member 130B for the holding block 110B in the left side in the same figure.

The pair of feeding members 121, 121 for integrating the plural dielectric barrier discharge lamps 101 are constituted by rod-shaped members extending in the direction of the arrangement of the discharge tubes 103, and are provided with slots 122 as openings along the longitudinal direction, similarly to the beam members 130, so that the connection protruding portions 112 formed on the non-facing surfaces 110D of the holding blocks 110, 110 can be fitted therein to be held thereby. Hereafter, the pair of the feeding members 121, 121 are referred to as "a feeding member 121A and a feeding member 121B" when they are distinguished from each other.

The material of the feeding members 121 may be any conductive material such as an aluminum alloy, stainless steels (SUS) or brass, but is preferably an aluminum alloy in view of the cost and the workability. It is particularly preferred to use, as the respective feeding members 121, general-purpose C channels made of a stainless steel, similarly to the beam members 130, since the use thereof can further reduce the cost. The feeding member 121A is electrically connected to a high-voltage terminal (an example of a first power-supply terminal, not shown) in a power supply device for applying AC voltages thereto, and also functions as a first support member 121A for comprehensively supporting the holding blocks 110A in the plural dielectric barrier discharge lamps 101. The other feeding member 121B is electrically connected to an earth terminal (an example of a second power-supply terminal, not shown) in the power supply device, and also functions as a second support member 121B for comprehensive support of the holding blocks 110B in the plural dielectric barrier discharge lamps 101.

The feeding members 121, 121 are provided with screw insertion holes 123 that allow the first screw members 140A to be inserted through. The feeding members 121, 121 are coupled to the connection pieces 135 and to the holding blocks 110 of the respective dielectric barrier discharge lamps 101, through the first screw portions 140A screwed thereinto.

One end portion 130D (left end portion in FIG. 14) of the beam member 130B to which the electrode 105A in a dielectric barrier discharge lamp 101A is mounted is coupled to the connection piece 135 through the second screw portion 140B screwed thereinto. This connection piece 135 is connected to the feeding member 121B by the first screw member 140A screwed thereinto. Therefore, the electrode 105A and the feeding member 121B are electrically connected to each other. On the other hand, the other end portion 130C (the right end portion in FIG. 14) of the beam member 130B to which the electrode 105A is mounted is coupled to the holding block 110A by the second screw portion 140B screwed thereinto. Therefore, the electrode 105A and the feeding member 121A are electrically insulated from each other.

Further, one end portion 130D (the right end portion in FIG. 14) of the beam member 130A to which the electrode 105B in the dielectric barrier discharge lamp 101A is mounted is coupled to the connection piece 135 by the second screw portion 140B screwed thereinto, and this connection piece 135 is connected to the feeding member 121A by the first screw member 140A screwed thereinto. Thus, the electrode 105B and the feeding member 121A are electrically connected to each other. On the other hand, the other end portion 130C (the left end portion in FIG. 14) of the beam member 130A to which the electrode 105B is mounted is coupled to the holding block 110B by the second screw portion 140B screwed thereinto. Therefore, the electrode 105B and the feeding member 121B are electrically insulated from each other.

On the other hand, one end portion 130D (the right end portion in FIG. 14) of the beam member 130B to which the electrode 105A of a dielectric barrier discharge lamp 101B is mounted is coupled to the connection piece 135 by the second screw portion 140B screwed thereinto, and this connection piece 135 is connected to the feeding member 121A by the first screw member 140A screwed thereinto. Thus, the electrode 105A and the feeding member 121A are electrically connected to each other. On the other hand, the other end portion 130C (the left end portion in FIG. 14) of the beam member 130B to which the electrode 105A is mounted is coupled to the holding block 110B by the second screw portion 140B screwed thereinto. Therefore, the electrode 105A and the feeding member 121B are electrically insulated from each other.

Further, one end portion 130D (the left end portion in FIG. 14) of the beam member 130A to which the electrode 105B of the dielectric barrier discharge lamp 101B is mounted is coupled to the connection piece 135 by the second screw portion 140B screwed thereinto, and this connection piece 135 is connected to the feeding member 121B by the first screw member 140A screwed thereinto. Thus, the electrode 105B and the feeding member 121B are electrically connected to each other. On the other hand, the other end portion 130C (the right end portion in FIG. 14) of the beam member 130A to which the electrode 105B is mounted is coupled to the holding block 110A by the second screw portion 140B screwed thereinto. Therefore, the electrode 105B and the feeding member 121A are electrically insulated from each other.

Further, the electrode 105A in the above dielectric barrier discharge lamp 101B is connected to the above high-voltage terminal in the power supply device via the beam member 130 and the feeding member 121A, and the electrode 105B in the above dielectric barrier discharge lamp 101B is connected to the earth terminal via the beam member 130 and the feeding member 121B. Further, in two adjacent dielectric barrier discharge lamps 101A and 101B, the electrodes 105A and 105B facing each other are commonly connected to one of the feeding members 121A and 121B.

In FIG. 14, the electrodes 105B of the dielectric barrier discharge lamps 101A and the electrodes 105A of the dielectric barrier discharge lamps 101B adjacent thereto are connected to the feeding member 121A. Further, the electrodes 105B of the dielectric barrier discharge lamps 101B and the electrodes 105A of the dielectric barrier discharge lamps 101A adjacent thereto are connected to the feeding member 121B.

Therefore, for example, in a structure in which one electrode 105A and the other electrode 105B, out of two electrodes facing each other, are connected to the feeding members 121A and 121B, respectively, it is possible to prevent occurrence of a short circuit between the electrodes 105A and 105B. This enables placing the respective dielectric barrier discharge lamps 101A and 101B proximally to each other.

Next, there will be described effects of this embodiment.

In this embodiment, a pair of the electrodes 105, 105 are placed such that the light extraction area 103A is positioned between the electrodes 105, 105 in the peripheral direction of the outer peripheral surface of the discharge tube 103, and no electrode 105 is present in the light extraction area 103A.

Accordingly, according to this embodiment, similarly to in the first embodiment, it is possible to increase the light transmittance and to easily remove contaminations in the light extraction area 103A. Further, even sputtering occurs at the electrodes 105, it is possible to suppress adhesion of metal films to the light extraction area 103A, thereby suppressing degradation of the light transmittance of the light extraction area 103A.

Further, in this embodiment, no mesh electrode is employed. This can reduce labor and costs for forming such mesh electrodes on the discharge tubes 103, and can also prevent occurrence of the problems that have been induced in the structures employing mesh electrodes (such as the occurrence of wire breakages due to the contact between mesh electrodes and to-be-treated objects).

Further, in this embodiment, the plural dielectric barrier discharge lamps 101 are integrated by the feeding members 121 (the support members) and the beam members 130, in a state where they are placed in parallel. This can improve the usability of the plural dielectric barrier discharge lamps 101, for example, in such a way to use them as a flat-surface lamp at a predetermined installation portion, as enabling comprehensively extracting them from this installation place for performing replacement operations.

Further, in this embodiment, similarly to the third embodiment, since the pair of beam members 130, 130 are coupled to the pair of holding blocks 110, 110, the respective electrodes 105, 105 are pressed against the outer peripheral surface of the discharge tube 103 by the respective beam members 130, 130, which can certainly bring the upper and lower opposite edges of the respective electrodes 105, 105 into contact with the outer peripheral surface of the discharge tube 103.

Particularly, in this embodiment, the electrodes 105 are provided with the displacement prevention protruding portions 107 which are formed to protrude in directions intersecting with the longitudinal direction and are adapted to be inserted in the slots 131 in the beam members 130 to prevent displacement of the electrodes 105, 105 with a flat-plate shape. Thus, the electrodes 105 are positioned at predetermined positions on the beam members 130 and are inhibited from being displaced therefrom, which can ensure a preferable contact state therebetween.

Further, in this embodiment, the electrodes 105 are provided with the plural slits 106 in directions intersecting with the longitudinal direction, which can release heat therefrom to prevent deformation of the electrodes 105 due to thermal expansion thereof, when the electrodes 105 are subjected to heat.

(Other Embodiments)

This invention is not limited to the embodiments having been described with respect to the aforementioned description and the drawings and, for example, various aspects as follows are also included in the technical scope of this invention.

(1) While in the above embodiments the light extraction area is a facing portion (a lower portion of the discharge tube 3) facing the to-be-treated objects, this invention is not limited thereto, and the light extraction area can alternatively be a portion (an upper portion of the discharge tube 3) opposite to the facing portion. For example, some UV irradiation devices are provided with a reflective plate above dielectric barrier discharge lamps (in the opposite side from to-be-treated objects) to reflect, by the reflection plate, the light emitted from the upper portions of the dielectric barrier discharge lamps for directing it toward to-be-treated objects. In such dielectric barrier discharge lamps for use in this way, the upper portions of the discharge tubes are light extraction areas.

(2) While in the above embodiments the pair of the side-surface electrodes 5, 5 are placed such that the straight lines which connect their respective positions to the center axis of the discharge tube 3 form an angle of about 180 degrees, this invention is not limited thereto. For example, they can be placed in such a way to form an angle of 132 degrees. Namely, the pair of the side-surface electrodes 5, 5 are only required to "be placed on the outer peripheral surface such that the light extraction area is positioned between the pair of the electrodes in the peripheral direction of the outer peripheral surface". However, there is a need for spacing the pair of the electrodes 5, 5 from each other, to such an extent as to prevent short circuits therebetween.

(3) While in the above embodiments the side-surface electrodes 5A and 5B with rod shapes and flat-plate shapes are employed, this invention is not limited thereto. For example, it is also possible to employ electrodes made of a conductive material having a mesh shape, a stripe shape, a radial shape or a spiral shape. Further, it is also possible to employ thin-film electrodes or printed electrodes which have been formed on the discharge tube 3 by plating, thermal spraying, vapor deposition or sputtering. However, with the structure (rod-shaped electrodes) of the first embodiment, the merit of making the electrodes 5A and 5B function as structural members (beams) is possible.

With thin-film electrodes, in cases where their material is aluminum, the merit of increasing the intensity of UV ray is possible, since aluminum can highly reflect UV ray. However, if they have overly small film thicknesses, they have increased resistances. If they have larger film thicknesses, larger stresses are induced causing peeling thereof. In consideration of these facts, it is preferred to form electrodes by thermal spraying, since it is possible to form electrodes having appropriate film thicknesses.

In cases of vapor deposition, a vacuum chamber is required. However, in cases of thermal spraying, a vacuum chamber is not required, which reduces the cost thereof. Further, in cases of forming the electrodes through thermal spraying, it is preferred to perform thermal spraying with aluminum, in view of preferable adhesion thereof.

(4) While in the above embodiments the reflective film 9 is formed on the outer surface of the discharge tube 3, this invention is not limited thereto; it can alternatively be formed on the inner surface of the discharge tube 3. Particularly, in cases where the reflective film 9 may be degraded to form particles, due to irradiation of UV ray, and thus induce the problem that such particles fall onto to-be-treated objects, it is preferred to form the reflective film 9 on the inner surface of the discharge tube 3. However, such a structure involves increases of burdens and costs for fabrication. Therefore, it is preferred to employ the structures according to the above embodiments, provided that the above problem may not be induced.

(5) While in the above first and second embodiments the side-surface electrodes 5, 5 are constituted by rod-shaped members, this invention is not limited thereto. For example, at least one of the side-surface electrodes 5, 5 can be constituted by a mesh electrode or the like, and the holding blocks 7, 7 can be coupled to each other via other structural members. However, with the structures of the above embodiments, it is possible to produce the merits of reducing the number of members, and the like.

(6) While, in the above third embodiment the electrodes 41 constituted by flat springs are employed, this invention is not limited thereto. For example, it is also possible to employ electrodes made of a conductive material (including a conductive rubber) other than stainless steels. Also, it is possible to employ mesh electrodes.

(7) While in the above embodiments two members (the side-surface electrode 5 and the beam member 43) functioning as beam members are provided to each dielectric barrier discharge lamp, this invention is not limited thereto. For example, the entire lamp unit can either be structured to include only one beam member or be structured to include a single beam member at each of its end portions in the forward and rearward directions. Also, it is possible to constitute the neighboring side-surface electrodes 5A and 5B in the above first and second embodiments by a common member.

(8) While in the above embodiments the coil springs 51 are employed as biasing members, this invention is not limited thereto. It is possible to employ any members capable of biasing the facing electrodes in such directions that they get away from each other, such as flat springs or rubber members.

(9) While it is described in the above fifth embodiment a structure including the electrodes 105, 105 provided with slits 106 in directions intersecting the longitudinal direction of the electrodes and also provided with displacement prevention protruding portions 107, this invention is not limited thereto. The electrodes can be provided with only the displacement prevention protruding portions 107 or the slits 106. Also, the slits 106 can be formed in directions substantially parallel to the longitudinal direction.

(10) While the above embodiments describe structures including discharge tubes made of a synthetic silica glass, the material of the discharge tubes is not limited thereto. For example, it is also possible to employ glasses other than synthetic silica glasses, provided that they allow emission of light in wavelength ranges higher than the vacuum ultraviolet range which is equal to or less than 200 nm, such as a wavelength of 222 nm In cases of employing a fluorine-based discharge gas, it is preferred to perform fluorine-resistant processing on the inner surface of the glass.

The invention claimed is:

1. A dielectric barrier discharge lamp, comprising:

a discharge tube having an elongated shape and enclosing a discharge gas therein;

a pair of electrodes;

a pair of holding blocks adapted to hold respective end portions of the discharge tube in a longitudinal direction of the discharge tube, and a beam member which comprises a rod-shaped member extending in the longitudinal direction and, further, is coupled to the holding blocks, at its respective end portions in the longitudinal direction, wherein a portion of an outer peripheral surface of the discharge tube in the longitudinal direction of the discharge tube is defined as a light extraction area for extracting light induced in the discharge tube to an outside, and the pair of the electrodes are placed on the outer peripheral surface such that the light extraction area is positioned between the pair of the electrodes in a peripheral direction of the outer peripheral surface, wherein at least one electrode, out of the pair of the electrodes, is placed between the beam member and the outer peripheral surface of the discharge tube and is adapted to be pressed against the outer peripheral surface by the beam member coupled to the holding blocks.

2. The dielectric barrier discharge lamp according to claim 1, wherein at least one electrode, out of the pair of the electrodes, has a rod shape extending in the longitudinal direction, and this rod-shaped electrode is coupled at its respective end portions to the holding blocks.

3. The dielectric barrier discharge lamp according to claim 2, wherein the discharge tube comprises a round tube having a circular-shaped cross section, and an inner surface of the rod-shaped electrode which faces the discharge tube forms a curved surface, and this inner surface has a curvature equal to or less than a curvature of the outer peripheral surface of the discharge tube.

4. The dielectric barrier discharge lamp according to claim 2, wherein an outer surface of the rod-shaped electrode other than the inner surface facing the discharge tube is provided with a tapered surface between adjacent surfaces.

5. The dielectric barrier discharge lamp according to claim 2, wherein the holding blocks are provided, in their facing surfaces which face the end portions of the discharge tube in the longitudinal direction, with a discharge-tube housing portion adapted to house the discharge tube, and with electrode housing portions which are placed to sandwich the discharge-tube housing portion therebetween and are adapted to house the pair of the electrodes.

6. The dielectric barrier discharge lamp according to claim 5, wherein the holding blocks are provided with through holes which are continuous with back surfaces of the electrode housing portions facing end surfaces of the electrodes and reach non-facing surfaces of the holding blocks in the opposite side from their facing surfaces, and the end surfaces of the electrodes are provided with screw holes which allow screws inserted through the through holes to be screwed thereinto.

7. The dielectric barrier discharge lamp according to claim 6, wherein an angle of the end surfaces of the electrodes with respect to a direction perpendicular to the longitudinal direction of the discharge tube is different from an angle of the back surfaces of the electrode housing portions with respect to the direction perpendicular to the longitudinal direction of the discharge tube, whereby the electrodes are caused to press the discharge tube when the electrodes are coupled to the holding blocks.

8. The dielectric barrier discharge lamp according to claim 2, wherein a conductive elastic member is inserted between the discharge tube and the one electrode, in a state where the elastic member is being elastically deformed.

9. The dielectric barrier discharge lamp according to claim 1, wherein at least one electrode, out of the pair of the electrodes, has a flat-plate shape extending in the longitudinal direction, the beam member is provided with a slot in the longitudinal direction, in its facing surface which faces the outer peripheral surface, and the one electrode is pressed against the outer peripheral surface while being curved into a U shape by being pressed by opposite edges of the slot in the facing surface, by being coupled to the holding blocks.

10. The dielectric barrier discharge lamp according to claim 9, wherein the electrode having the flat-plate shape extending in the longitudinal direction is provided with plural slits.

11. The dielectric barrier discharge lamp according to claim 9, wherein the electrode having the flat-plate shape extending in the longitudinal direction is provided with a displacement prevention protruding portion which is formed to protrude in a direction intersecting with the longitudinal direction and is inserted in the slot in the beam member for preventing displacement of the electrode having the flat-plate shape.

12. The dielectric barrier discharge lamp according to claim 2, wherein the discharge tube comprises a round tube having a circular-shaped cross section, the discharge tube is provided with an engagement portion, and at least one holding block, out of the pair of the holding blocks, is provided with a to-be-engaged portion adapted to engage with the engagement portion.

13. The dielectric barrier discharge lamp according to claim 1, wherein out of two portions of the discharge tube which are sandwiched between the pair of the electrodes, one portion is defined as the light extraction area, while an insulating reflective film is formed on the other portion.

14. A lamp unit comprising;

a dielectric barrier discharge lamp arrangement comprising a plurality of the dielectric barrier discharge lamps according to claim 2, such that the dielectric barrier discharge lamps are placed and arranged in a direction intersecting with the longitudinal direction of the discharge tubes;

a first support member adapted to comprehensively support the holding blocks in the dielectric barrier discharge lamps in one side in the longitudinal direction; and a second support member adapted to comprehensively support the holding blocks in the dielectric barrier discharge lamps in the other side in the longitudinal direction.

15. The lamp unit according to claim 14, wherein the first support member comprises a feeding member connected to a first power-supply terminal connected to a power supply, the second support member comprises a feeding member connected to a second power-supply terminal connected to the power supply, and in two of the dielectric barrier discharge lamps which are adjacent to each other, the electrodes facing each other are commonly connected to one of the first supporting member and the second supporting member.

16. The lamp unit according to claim 14, wherein the first support member comprises a feeding member which comprises a conductive rod-shaped member extending in the intersecting direction and is connected to a first power-supply terminal connected to a power supply, the second support member comprises a feeding member which comprises a conductive rod-shaped member extending in the intersecting direction and is connected to a second power-supply terminal connected to the power supply, out of the pair of the electrodes included in each of the dielectric barrier discharge lamps, one electrode is electrically connected to the first support member, while the other electrode is electrically connected to the second support member.

17. The lamp unit according to claim 14, wherein between two dielectric barrier discharge lamps adjacent to each other, there is provided a biasing member for biasing the electrodes facing each other, in directions that they get away from each other.

* * * * *